US007904976B2

(12) United States Patent
Hakamiun et al.

(10) Patent No.: US 7,904,976 B2
(45) Date of Patent: Mar. 15, 2011

(54) ENDBOARD FOR A PATIENT SUPPORT

(75) Inventors: Reza Hakamiun, Charleston, SC (US); Thom Uzzle, Mt. Pleasant, SC (US); Jon Mueller, Mt. Pleasant, SC (US)

(73) Assignee: Hill-Rom Services, Inc., Batesville, IN (US)

( * ) Notice: Subject to any disclaimer, the term of this patent is extended or adjusted under 35 U.S.C. 154(b) by 894 days.

(21) Appl. No.: 11/741,214

(22) Filed: Apr. 27, 2007

(65) Prior Publication Data

US 2008/0263771 A1 Oct. 30, 2008

(51) Int. Cl.
*A61G 7/05* (2006.01)

(52) U.S. Cl. ..... 5/53.1; 5/600

(58) Field of Classification Search ..... 5/53.1, 5/616, 600, 284, 423, 503.1, 658
See application file for complete search history.

(56) References Cited

U.S. PATENT DOCUMENTS

| | | | | |
|---|---|---|---|---|
| 2,097,751 | A | | 11/1937 | Baltich |
| 2,186,142 | A | * | 1/1940 | Lieberman ..... 5/284 |
| 2,701,374 | A | | 2/1951 | Hillenbrand et al. |
| 3,231,905 | A | | 2/1966 | Brochu |
| 3,345,023 | A | | 10/1967 | Scott et al. |
| 3,899,149 | A | | 8/1975 | Schneider |
| 4,488,322 | A | | 12/1984 | Hunt et al. |
| 4,525,885 | A | | 7/1985 | Hunt et al. |
| 4,724,555 | A | | 2/1988 | Poehner et al. |
| 4,768,241 | A | | 9/1988 | Beney |
| 4,988,062 | A | | 1/1991 | London |
| 5,054,723 | A | | 10/1991 | Arnold |
| 5,224,674 | A | | 7/1993 | Simons |
| 5,226,892 | A | | 7/1993 | Boswell |
| 5,267,364 | A | | 12/1993 | Volk |
| 5,269,388 | A | | 12/1993 | Reichow et al. |
| 5,279,010 | A | | 1/1994 | Ferrand et al. |
| 5,425,148 | A | | 6/1995 | Ashcraft et al. |
| 5,586,346 | A | | 12/1996 | Stacy et al. |
| 5,611,096 | A | | 3/1997 | Bartlett et al. |
| 5,623,736 | A | | 4/1997 | Soltani et al. |
| 5,647,079 | A | | 7/1997 | Hakamiun et al. |
| 5,699,038 | A | | 12/1997 | Ulrich et al. |
| 5,802,640 | A | | 9/1998 | Ferand et al. |
| 5,906,016 | A | | 5/1999 | Ferrand et al. |
| 5,906,017 | A | | 5/1999 | Ferrand et al. |
| 5,944,494 | A | | 8/1999 | Soltani et al. |
| 5,971,913 | A | | 10/1999 | Newkirk et al. |

(Continued)

FOREIGN PATENT DOCUMENTS

CA 2461167 AA 4/2003

(Continued)

OTHER PUBLICATIONS

Office Action dated Nov. 27, 2007 in U.S. Appl. No. 11/968,892, Conf No. 5872, Inventor, Reza Hakamiun, pp. 1-12.

(Continued)

*Primary Examiner* — Robert G Santos
(74) *Attorney, Agent, or Firm* — Barnes & Thornburg LLP

(57) ABSTRACT

An endboard such as a headboard or a footboard for a patient support is provided. The endboard is suitable for use in connection with care equipment, a service supply, and a service line operably coupling the service supply to the care equipment. The endboard includes at least one line support.

23 Claims, 17 Drawing Sheets

U.S. PATENT DOCUMENTS

| | | | | |
|---|---|---|---|---|
| 6,021,533 | A | 2/2000 | Ellis et al. | |
| 6,109,460 | A | 8/2000 | Herlevi et al. | |
| 6,178,576 | B1 | 1/2001 | Newell | |
| 6,208,250 | B1 | 3/2001 | Dixon et al. | |
| 6,212,718 | B1 | 4/2001 | Stolpmann et al. | |
| 6,290,194 | B1 | 9/2001 | Chaconas et al. | |
| 6,295,675 | B1 | 10/2001 | Ellis et al. | |
| 6,320,510 | B2 | 11/2001 | Menkedick et al. | |
| 6,321,878 | B1 | 11/2001 | Mobley et al. | |
| 6,438,776 | B2 | 8/2002 | Ferrand et al. | |
| 6,467,111 | B1 | 10/2002 | Vrzalik et al. | |
| 6,467,113 | B2 | 10/2002 | Ellis et al. | |
| 6,751,815 | B2 | 6/2004 | Heimbrock et al. | |
| 6,829,796 | B2 | 12/2004 | Salvatini et al. | |
| 7,057,889 | B2 | 6/2006 | Mata et al. | |
| 7,310,839 | B2 * | 12/2007 | Salvatini et al. | 5/280 |
| 7,418,747 | B1 * | 9/2008 | Myers | 5/308 |
| 2003/0061664 | A1 | 4/2003 | Salvatini et al. | |
| 2005/0091753 | A1 | 5/2005 | Salvatini et al. | |
| 2005/0166324 | A1 | 8/2005 | Dixon et al. | |
| 2006/0162068 | A1 | 7/2006 | Risk, Jr. et al. | |
| 2006/0195986 | A1 | 9/2006 | Hakamiun et al. | |
| 2008/0263771 | A1 * | 10/2008 | Hakamiun et al. | 5/600 |

FOREIGN PATENT DOCUMENTS

| | | | |
|---|---|---|---|
| CA | 2505102 | AA | 9/2006 |
| DE | 69410567 | C0 | 7/1998 |
| EP | 0626534 | B1 | 6/1996 |
| EP | 0649645 | B1 | 5/1998 |
| EP | 1448148 | A1 | 8/2004 |
| EP | 1344513 | B1 | 8/2006 |
| JP | 07155349 | A2 | 6/1995 |
| WO | WO03002861 | A1 | 4/2003 |

OTHER PUBLICATIONS

Office Action dated Jun. 2, 2008 in U.S. Appl. No. 11/368,982, Conf. No. 5872, Inventor, Reza Hakamiun, pp. 1-9.

* cited by examiner

ENDBOARD FOR A PATIENT SUPPORT

BACKGROUND OF THE INVENTION

The present disclosure relates to a patient support. Particularly, the present disclosure relates to a barrier for a patient support. More particularly, the present disclosure relates to an endboard, such as a headboard or a footboard, for a patient support such as a hospital bed.

Care equipment, for example diagnostic, monitoring, treatment, comfort adjustment and/or communication devices and systems, may be used in providing health-related services to individuals. Such individuals may be supported at least in part by a patient support such as a hospital bed. A mattress may be considered an example of care equipment.

A service supply may be utilized by or coupled to such care equipment, in order to render the care equipment operable and/or to enable the care equipment to provide services to an individual. For example, a service supply may provide one or more utilities or services for use by the care equipment, including: fluids, such as heated or cooled water; pressurized air, heated or cooled air; electrical power; electrical data signals; and others.

The service supply may be remote from the care equipment, in which case hoses, electrical power cables, electrical data cables, wires or other service lines may be utilized to operably couple the service supply to the care equipment or other service supplies.

It may be convenient to locate the service supply near or on at least a portion of a patient support, such as a hospital bed endboard. In such circumstances, it may be desirable to support and arrange at least a portion of one or more of the service lines to facilitate care of an individual, enable or improve the ease of use of the care equipment by a caregiver, for safety purposes, or for other reasons.

SUMMARY OF THE INVENTION

The present disclosure comprises one or more of the features recited in the appended claims and/or the following features which, alone or in any combination, may comprise patentable subject matter:

In one embodiment, an endboard for a patient support is provided, the patient support including a frame having a head end and a foot end, care equipment adjacent the frame, a service supply, and a service line operably coupling the service supply to the care equipment. The endboard includes a housing having a front surface, a back surface spaced apart from the front surface by a depth of the housing, a top, a bottom spaced apart from the top by a height of the housing, and a first end, and a second end spaced apart from the first end by a width of the housing. The front surface faces outwardly, away from the patient support, when the endboard is installed on the patient support. The top extends upwardly from the patient support when the endboard is installed on the patient support. At least a portion of the front surface cooperates with at least a portion of the back surface to define an interior region, and at least one of the front surface and the back surface define a service supply mounting region having a perimeter generally corresponding to a perimeter of the service supply when the service supply is mounted to the housing. A line support is located proximate to the service supply mounting region and is configured to support at least a portion of the service line.

The endboard may further include a second line support located proximate to the service supply mounting region. The second line support is spaced apart from the first line support and is configured to support a second portion of the service line.

The line support may include a first leg and a second leg spaced apart from the first leg. The first leg may cooperate with the second leg to define a space between the first and second legs that is configured to receive the service line. The line support may be integrally appended to the front surface or the line support may be coupled to the front surface.

A shelf may be coupled to the front surface of the housing and may extend generally outwardly away from the front surface. The shelf may include a top surface that cooperates with the front surface of the housing to define the line support. The line support may be appended to the top surface of the shelf.

An edge may define an aperture extending through one of the front surface, the back surface, the top, the bottom, the first end, and the second end of the housing. The aperture may be in communication with the interior region of the housing and at least a portion of the edge may define the line support.

A first edge may define a first aperture extending through one of the front surface, the back surface, the top, the bottom, the first end, and the second end of the housing. A second edge may define a second aperture extending through one of the front surface, the back surface, the top, the bottom, the first end, and the second end of the housing. A surface may extend between the first edge and the second edge and the surface may define a channel between the first edge and the second edge. At least a portion of the surface may define the line support.

A first edge may define a first aperture extending through the front surface and a second edge may define a second aperture extending through the back surface. A first channel surface may extend between the first edge and the second edge and the first channel surface may define a first channel between the first edge and the second edge. A third edge may define a third aperture extending through the front surface and a fourth edge may define a fourth aperture extending through the back surface. A second channel surface may extend between the third edge and the fourth edge and the second channel surface may define a second channel between the third edge and the fourth edge. A fifth edge may define a fifth aperture extending through the first channel surface and a sixth edge may define a sixth aperture extending through the second channel surface. A third channel surface may extend between the fifth edge and the sixth edge and may define a third channel between the fifth edge and the sixth edge. At least a portion of at least one of the first, second, and third channel surfaces may define the line support.

A first edge may define a first aperture extending through the front surface and a second edge may define a second aperture extending through the back surface. A channel surface may extend between the first edge and the second edge and the channel surface may define a first channel between the first edge and the second edge. A third edge may define a third aperture extending through the first channel surface. At least a portion of the third edge may define the line support.

A first edge may define a first aperture extending through one of the front surface, the back surface, the top, the bottom, the first end, and the second end of the housing. A second edge may define a second aperture extending through one of the front surface, the back surface, the top, the bottom, the first end, and the second end of the housing. The second aperture may be in fluid communication with the first aperture. The service line may be a hose and the line support may be a hose coupler coupled to the housing adjacent the first aperture and configured to support the hose proximate to the housing. A second hose may be provided and a second line support may be provided. The second line support may be a second hose coupler coupled to the housing adjacent the second aperture. The second hose coupler may be configured to support the hose proximate to the housing so that the second hose is in fluid communication with the first hose through the second aperture and the first aperture.

The service line may be an electrical cable including a first end, a second end, and a connector appended to one of the first and second ends of the electrical cable. A first edge may define a first aperture extending through the front surface of the housing. The line support may be a first electrical connector fixed to the housing adjacent the first aperture. The first electrical connector may be configured to mate with the connector of the electrical cable so that the electrical cable is in electrical communication with the first electrical connector.

In another embodiment, an endboard for a patient support is provided. The endboard includes a housing having a front surface, a back surface spaced apart from the front surface by a depth of the housing, a top, a bottom spaced apart from the top by a height of the housing, a first end and a second end spaced apart from the first end by a width of the housing. The front surface faces outwardly away from a patient support when the endboard is installed on the patient support. The top extends upwardly from the patient support when the endboard is installed on the patient support. At least a portion of the front surface cooperates with at least a portion of the back surface to define an interior region. A first aperture extends through the front surface of the housing and is sized to receive the service line. The first aperture is in communication with the interior region of the housing. At least a portion of the service line is positionable in the interior region of the housing. A second aperture is sized to receive the service line and the second aperture is in communication with the interior region of the housing.

The second aperture may extend through the back surface of the housing and may cooperate with the first aperture to define an axis extending in a direction that is generally perpendicular to the front surface of the housing. Likewise, the second aperture may extend through one of the first and second ends of the housing and may cooperate with the first aperture to define an axis extending in a direction that is generally parallel to the front surface of the housing.

The front surface of the housing may define a generally vertically-extending plane. The second aperture may extend through one of the back surface, the top, the bottom, the first end, and the second end of the housing. The second aperture may cooperate with the first aperture to define an axis that extends in a direction forming an angle to the plane of the front surface. The angle formed between the axis and the plane of the front surface may be an acute angle. Alternatively, the angle formed between the axis and the plane of the front surface may be an obtuse angle.

In another embodiment, an endboard for a patient support is provided. The endboard includes a panel including a top edge extending upwardly above the frame and a front surface facing outwardly from the frame. At least a portion of the front surface defines a service-line-receiving space. A retainer is configured to retain the service line in the service-line-receiving space.

The retainer may be a clip fixed to the front surface of the panel. The retainer may extend generally outwardly away from the front surface of the housing. The retainer may include flexible portions coupled to the front surface of the housing. The retainer may be integrally formed in the front surface of the panel.

A shelf may be coupled to the front surface of the panel. The shelf may be positioned to lie in a use position extending generally outwardly from the front surface of the panel. The shelf may include a top surface that cooperates with the front surface of the panel to define the service-line-receiving space. The retainer may be integrally formed in the top surface of the shelf.

In still another embodiment, an endboard for a patient support is provided. The endboard includes a panel having a top edge extending upwardly above a frame of the patient support and a coupler configured to secure the panel to the frame. The panel further includes first and second handles. A front surface of the panel faces outwardly away from the frame and a back surface of the panel is spaced apart from the front surface. The front surface includes a first edge defining a first channel opening. The back surface includes a second edge defining a second channel opening. A channel surface connects the first edge and the second edge and defines a channel extending from the front surface, through the panel, to the back surface.

The service line may be a hose. The channel may be configured to conduct air. A retainer may be provided and may be mounted adjacent one of the first and second apertures. The retainer may be configured to couple the hose to the endboard so that the hose is in fluid communication with the channel.

A second retainer may be provided and may be mounted adjacent the other of the first and second apertures. The second retainer may be configured to couple the hose to the endboard so that the hose is in fluid communication with the channel. The channel may define an axis extending generally normal to the front surface. Alternatively, the channel may define an axis extending generally parallel to the front surface.

A retainer may be mounted to the front surface of the panel adjacent the first channel opening. The retainer may be configured to couple the service line to the panel. The retainer also may be configured to operably couple the service line to the first channel opening, the channel, and the second channel opening.

The service line may be a first service line, the retainer may be a first retainer, and a second service line may be provided. The second service line may be configured to operably couple the service supply to the care equipment. A second retainer may be provided. The second retainer may be mounted to the back surface of the panel adjacent the second channel opening. The second retainer may be configured to couple the second service line to the panel. The second retainer also may be configured to operably couple the second service line to the second channel opening, the channel, the first channel opening, and the first service line. The care equipment may be a mattress defining an interior region including a bladder. The service supply may include an air supply. The first service line may be a first hose and the second service line may be a second hose. The channel may be configured so that the air supply is in fluid communication with the bladder through the first hose, through the channel, and through the second hose.

The channel may be a first channel and the channel surface may be the first channel surface. The front surface of the panel may include a third edge defining a third channel opening and the back surface of the panel may include a fourth edge defining a fourth channel opening. A second channel surface may connect the third edge and the fourth edge defining a second channel extending between the front surface and the back surface. The second channel may be configured to carry the service line.

In one embodiment, a hospital bed is provided. The hospital bed carries a mattress having a bladder defining an interior region and is provided with a hose and a service supply including an air supply operably coupled to the interior region of the bladder by the hose so that the air supply is in fluid communication with the bladder. The hospital bed includes a bed frame having a head end and a foot end, a coupler, and an endboard including a panel having a top edge extending upwardly from the bed frame. The coupler is configured to secure the panel to the bed frame adjacent at least one of the head end and the foot end of the bed frame.

The panel further includes first and second handles integrally appended to the panel. Each of the first and second handles is formed to include a grip and a finger-receiving space. A front surface of the panel faces outwardly away from the bed frame, and a back surface of the panel is spaced apart from the front surface by a depth. The front surface includes a first edge defining a first channel opening, the back surface includes a second edge defining a second channel opening, and a first channel surface connects the first edge and the second edge. The first channel surface defines a first channel extending from the front surface, through the panel, to the back surface. The first channel is configured to carry the hose. The first channel defines an axis extending generally normal to the front surface.

The front surface of the panel includes a third edge defining a third channel opening. The back surface of the panel includes a fourth edge defining a fourth channel opening. A second channel surface connects the third edge and the fourth edge. The second channel surface defines a second channel extending from the front surface, through the panel, to the back surface. The second channel is configured to carry the hose. The second channel defines an axis extending generally normal to the front surface.

In yet other embodiments, a patient support is provided. The patient support carries a mattress having a bladder defining an interior region. The patient support is provided with a service supply including an air supply, a first hose operably coupled to the air supply, and a second hose operably coupled to the mattress. The first hose is operably coupled to the service supply and the second hose is operably coupled to the interior region of the bladder. The patient support includes a bed frame having a head end and a foot end, a coupler, and an endboard including a panel having a top edge extending upwardly from the bed frame. The coupler is configured to couple the panel to the bed frame adjacent at least one of the head end and the foot end of the bed frame.

The panel further includes first and second handles integrally appended to the panel. Each of the first and second handles is formed to include a grip and a finger-receiving space. The panel includes a front surface facing outwardly away from the bed frame and a back surface spaced apart from the front surface. The front surface of the panel includes a first edge defining a first channel opening. The back surface of the panel includes a second edge defining a second channel opening. A channel surface connects the first edge and the second edge. The channel surface defines a channel extending from the front surface, through the panel, to the back surface.

A first hose coupler is mounted to the front surface of the panel adjacent the first channel opening. The first hose coupler is in fluid communication with the first channel opening. The first hose coupler is configured to couple the first hose to the panel and to bring the first hose into fluid communication with the channel. A second hose coupler is mounted to the back surface of the panel adjacent the second channel opening. The second hose coupler is in fluid communication with the second channel opening. The second hose coupler is configured to couple the second hose to the panel and to bring the second hose into fluid communication with the channel so that the air supply is in fluid communication with the bladder through the first hose, the first channel opening, the channel, the second channel opening, and the second hose.

In another embodiment, an endboard for a patient support is provided. The endboard includes a housing having a front surface, a back surface spaced from the front surface by a depth, a top, a bottom spaced from the top by a height, a first end, and a second end spaced apart from the first end by a width. The front surface cooperates with the back surface to define an interior region. A service line is configured to communicate at least one service between at least one service supply and at least one piece of care equipment. The service line includes a first end and a second end. An inlet is operably coupled to the first end and is configured to be operably coupled to at least one service supply. The service line also includes an outlet operably coupled to the second end, the outlet configured to be operably coupled to at least one piece of care equipment. At least a portion of the service line is positioned to lie in the interior region of the housing.

The service line may be an electrical cable configured to communicate an electrical power signal between the service supply and the care equipment through the interior region of the housing. The service line may be an electrical cable configured to communicate an electrical data signal between the service supply and the care equipment through the interior region of the housing. The service line may be a hose configured to communicate a fluid between the service supply and the care equipment through the interior region of the housing.

In still other embodiments, an endboard for a patient support is provided. The patient support includes an electrical power outlet and an electrical data outlet. The endboard includes a housing including a front surface, a back surface spaced from the front surface by a depth, a top, a bottom spaced from the top by a height, a first end, and a second end spaced apart from the first end by a width. The front surface cooperates with the back surface to define an interior region. An electrical cable is configured to communicate an electrical signal between the patient support and the service supply. The electrical cable includes a first end, a second end, and a first connector operably coupled to the first end. The first connector may be operably coupled to one of the electrical power outlet and the electrical data outlet. The electrical cable includes a second connector operably coupled to the second end. The second connector is configured to be operably coupled to at least one service supply. At least a portion of the electrical cable is positioned to lie in the interior region of the housing. The first connector is attached to the housing and is configured to automatically couple to the one of the electrical power outlet and the electrical data outlet of the patient support during installation of the endboard on the patient support.

In another embodiment, a mattress system for use with an electrical power source is provided. The mattress system includes a mattress having a bladder defining an interior region, a service supply including an air supply suitable to inflate the interior region of the bladder, and an endboard. The endboard includes a housing having first and second handles integrally formed in the endboard. Each handle includes a grip and each handle defines a finger-receiving space. The endboard includes a front surface and a back surface spaced apart from the front surface. The front surface and back surface cooperate to define an interior region.

The mattress system also includes a hose. The hose has a first end that may be coupled to the air supply and a second end that may be coupled to the bladder so that the bladder is in fluid communication with the air supply. At least a portion of the hose is received in the interior region of the housing when the first end of the hose is coupled to the air supply and the second end of the hose is coupled to the bladder. An electrical power cable has a first end that may be coupled to the service supply and a second end that may be coupled to the electrical power source. Electrical power is supplied to operate the air supply through the electrical power cable. At least a portion of the electrical power cable is received in the interior region of the housing when the first end of the electrical power cable is coupled to the service supply and the second end of the electrical power cable is coupled to the electrical power source.

In other embodiments, a patient support is provided. The patient support carries a mattress having a bladder defining an interior region. A service supply including an air supply suitable to inflate the interior region of the bladder is provided. The patient support includes a frame having a head end and a foot end. An electrical power connector is coupled to the frame adjacent the foot end of the frame and an electrical data connector is coupled to the frame adjacent the foot end of the frame. The patient support includes a coupler and an endboard. The endboard includes a housing having first and second handles integrally formed therein. Each handle includes a grip and each handle defines a finger-receiving space. The endboard includes front surface and a back surface spaced apart from the front surface. The front surface cooperates with the back surface to define an interior region. The coupler is configured to secure the housing to the frame adjacent the foot end of the frame.

The patient support includes a hose having a first end configured to be operably coupled to the air supply and a second end configured to be operably coupled to the bladder so that the bladder is in fluid communication with the air supply. At least a portion of the hose is received in the interior region of the housing when the first end of the hose is operably coupled to the air supply and the second end of the hose is operably coupled to the bladder.

An electrical power cable has a first end terminating in a first electrical power connector that is configured to be operably coupled to the service supply. The electrical power cable has a second end terminating in a second electrical power connector that is configured to be operably coupled to the electrical power connector of the frame so that electrical power is supplied to operate the air supply from the frame through the electrical power cable. At least a portion of the electrical power cable is received in the interior region of the housing when the first electrical power connector is operably coupled to the service supply and the second electrical power connector is operably coupled to the electrical power connector of the frame. The second electrical power connector fixed to the housing and positioned such that the electrical power connector is automatically operably coupled to the electrical power connector of the frame when the housing is coupled to the frame.

An electrical data cable has a first end terminating in a first electrical data connector and a second end terminating in a second electrical data connector. At least a portion of the electrical data cable is received in the interior region of the housing. The second electrical data connector is fixed to the housing and is positioned such that the second electrical data connector is automatically operably coupled to the electrical data connector of the frame when the housing is coupled to the frame.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

The present disclosure refers to a number of illustrative embodiments shown in the accompanying drawings and described herein.

Figure 1:
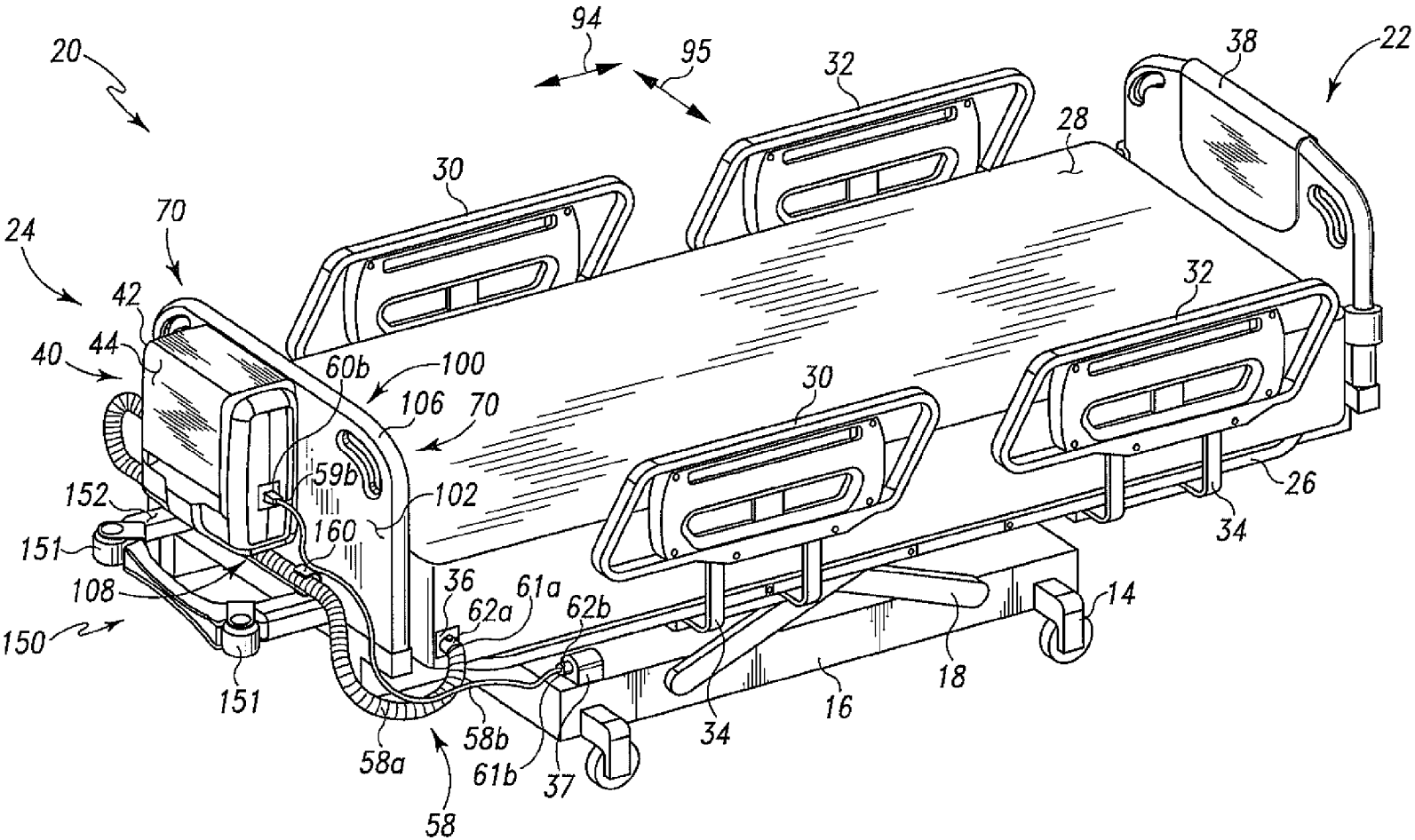
FIG. 1 is a perspective view of an exemplary patient support system in accordance with the present disclosure including a bed frame, a mattress supported by the bed frame, and endboards coupled to the bed frame, with one of the endboards supporting a service supply that may, among other things, supply air to at least a portion of the mattress by an air hose.

An exemplary patient support is shown in FIG. 1. Patient support 20 has a head end 22 and a foot end 24 and includes a base 16, a lifting and/or articulating mechanism 18, a frame 26 carrying a mattress 28, siderails 30, 32, and endboards 38, 100. Base 16 may be supported by casters 14. Frame 26 may include one or more articulatable deck sections (not shown). Siderails 30, 32 are coupled to frame 26 by siderail couplers 34.

Patient support 20 may include a bed or support suitable for use in any care facility including homes, hospitals, medical clinics or centers, rehabilitation centers, acute healthcare facilities, sub-acute healthcare facilities, outpatient care facilities, long-term healthcare facilities, nursing homes, freestanding medical facilities, surgical centers, or other patient care provider facilities. Patient support 20 may additionally include a stretcher, an examination table, an operating room table, a procedural chair, or any other support for a patient or other person for which the use of endboards of the present disclosure may be suitable and with which the use of care equipment may be appropriate.

Mattress 28 is care equipment and mattress 28 includes at least one inflatable portion (not shown). The inflatable portion of mattress 28 may receive pressurized air from a service supply 40 as shown in FIG. 1. However, references to mattresses in this disclosure are not intended to limit the use of endboards disclosed herein to uses with mattresses. For example, care equipment may include therapeutic mattresses, air fluidized therapy surfaces, person transfer devices, person rotation devices, person turn-assisting devices, continuous lateral rotation devices, proning devices, person warming or cooling devices, devices for the treatment of deep vein thrombosis, devices for monitoring physiological parameters, or any other care equipment used by or for a person that may utilize a service supply, whether or not the care equipment is separate from or integrated with the patient support or a mattress. Thus, the term "care equipment" as used in this disclosure refers to any equipment used by or for people that utilize a service supply to provide services to the care equipment.

Endboards 38, 100, are, for example, a headboard 38 and a footboard 100. The term "endboard" may be used in this disclosure to refer to either headboard 38 or footboard 100. The term "endboard" also refers to any other headboard or footboard described in this disclosure, as will be made clear by the context in which the term is used. The features described in this disclosure are equally applicable to headboards and footboards of patient supports, even though illustrative embodiments generally depict the endboard as a footboard of a hospital bed.

Endboards described in this disclosure may include a panel 101 of a solid construction. In the alternative, endboards described in this disclosure may include a panel or housing defining an interior region. Thus, throughout this specification and claims, the terms "panel" and "housing" will be used synonymously and interchangeably. Endboard 100 includes a front surface 102 facing away from mattress 28, as shown in FIG. 1, a back surface (not shown) spaced apart from front surface 102 by a depth of endboard 100 and facing toward mattress 28, a bottom 107, a top 106 extending upwardly from bottom 107 and extending above mattress 28, top 106 being spaced apart from bottom 107 by a height of endboard 100, a first end 103, and a second end 105 spaced apart from first end 103 by a width of endboard 100. Panel 101 is molded from plastic, but may be made of different materials including wood, plastic, metal, and other materials, or combinations of materials, suitable for the construction of endboard panels.

Service supply 40 may provide one or more services to mattress 28 or a variety of other care equipment used in the care of patients. In general, service lines 58 such as an air hose **58*a* and a cable 58*b* may couple service supply 40 to care equipment, to control electronics, and/or to a power source. For example, in FIG. 1 air hose 58*a* operably couples service supply 40 to a mattress coupler 36 of mattress 28 to provide air to inflatable portions of mattress 28, and cable 58*b* electrically couples service supply 40 to a power connector 37 illustratively located on base 16 of patient support 20**.

While illustrative service supply 40 includes an air supply (not shown), service supply 40 may be used to manage or provide one or more services for use by care equipment depending upon the capabilities of the care equipment and the desires of the caregiver. For example, service supply 40 may manage or provide, among others, any one or any combination of the following services: fluids, for example, medical gases, heated or cooled water or other liquids, heated or cooled air, pressurized air provided as a steady stream to a low air loss therapeutic mattress, pressurized air provided as needed to maintain a selected pressure within one or more mattress air bladders, pressurized air that is pulsed to provide vibration or percussion therapy, and pressurized air that is managed among bladders to provide alternating pressure therapy, turn assist, or continuous lateral rotation therapy, among other therapies and care equipment functions; electrical power; electrical data signals; and other utilities or services that may be suitable for use by the care equipment. Service supplies for those services may be packaged together into one housing or may be provided in separate housings. In additions, the term "service supply" may include other sources for the supply of services, including, for example, sources of services accessible from outlets associated with the walls, ceiling, and/or floor of a room, with a headwall, with a column, and with a boom arm.

Service supply 40 includes a housing 42 defining an interior region (not shown). A compressor, a blower, or another source of pressurized air (hereinafter "air supply," not shown) configured to provide pressurized air to mattress 28 may be located in the interior region. Hose **58*a* is operably coupled to the air supply of service supply 40 and to mattress 28 so that pressurized air generated by the air supply travels from service supply 40 through hose 58*a* to mattress 28**.

Figure 3:
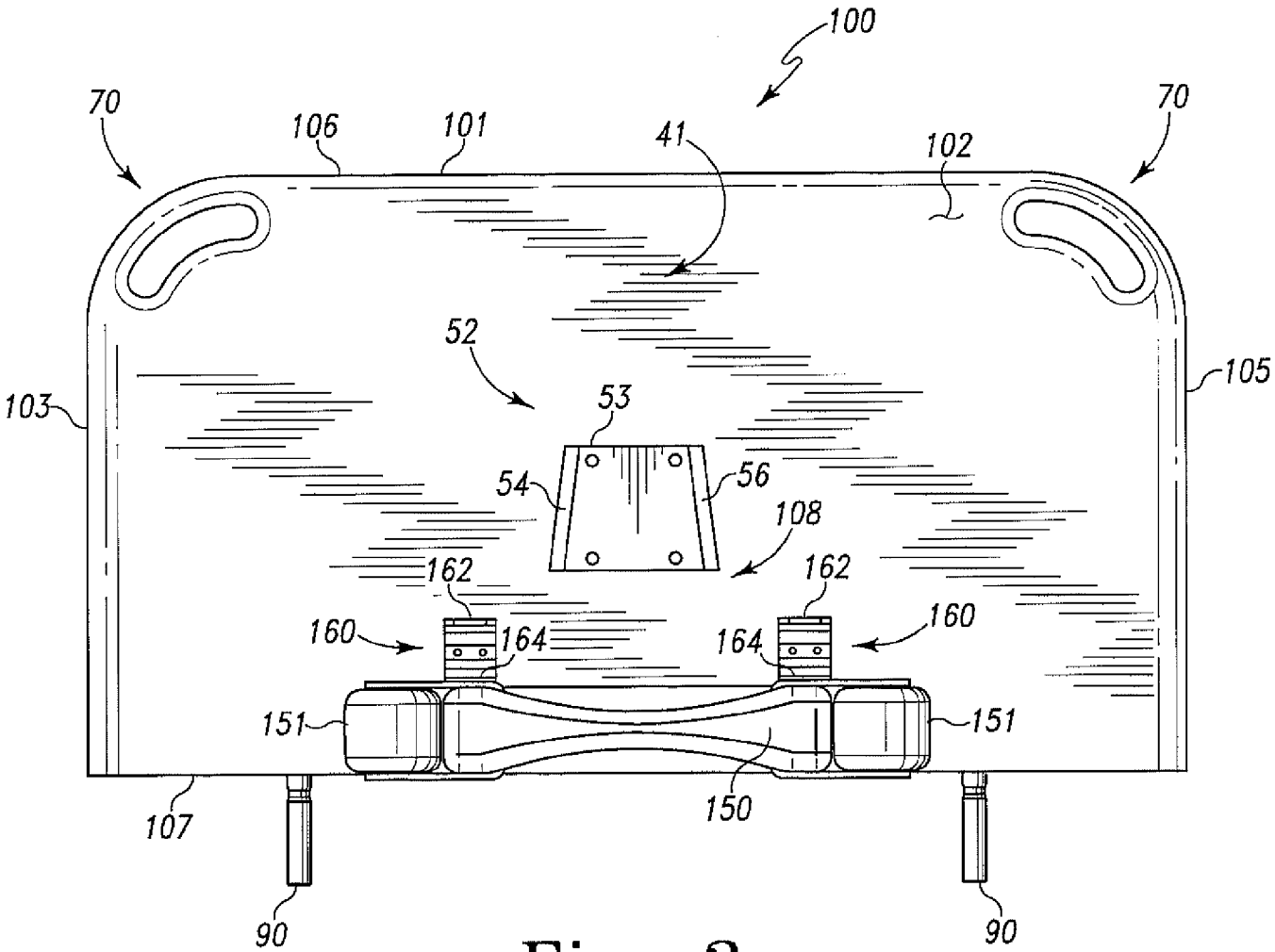
FIG. 3 is a front elevation view of the endboard of FIG. 2 without a service supply mounted thereto, including an optional service-supply coupler affixed to a front surface of the endboard.

Service supply 40 is releasably mounted to endboard 100 by a service-supply coupler 52 coupled to front surface 102 of endboard 100, as shown best in FIG. 3. Service-supply coupler 52 is configured to engage a mating bracket (not shown) coupled to the back surface (not shown) of service supply 40. Service-supply coupler 52 is optional and service supply 40 may be mounted to endboard 100 and to each of the illustrated endboards described in this disclosure using any suitable mounting method or apparatus, such as, for example, hooks (not shown) coupled to housing 42 of service supply 40 and configured to loop over top 106 of endboard 100. While service supply 40 is shown to be mounted adjacent front surface 102 of endboard 100, service supply 40 may likewise be mounted adjacent the back surface of endboard 100 if so desired.

Figure 4:
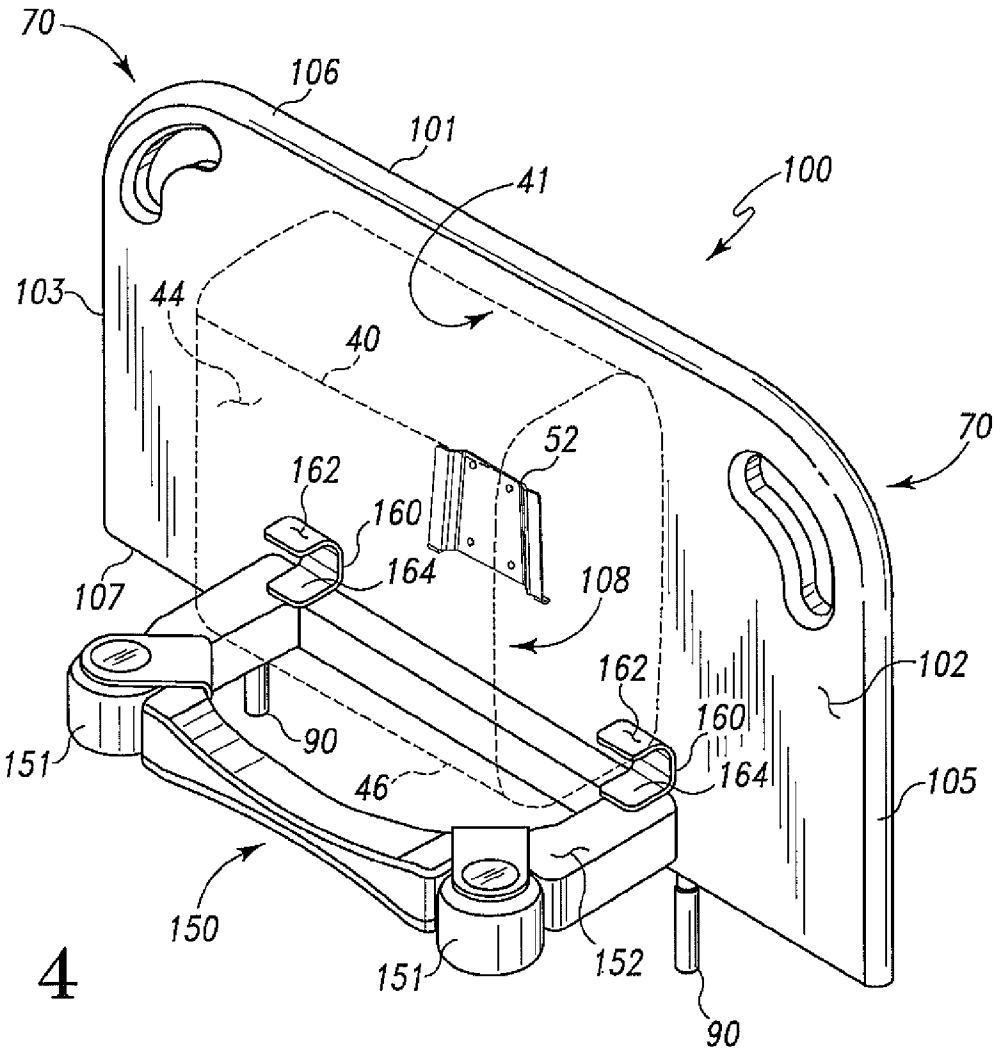
FIG. 4 is a perspective view of the endboard of FIG. 3 supporting a service supply (shown in phantom)
Figure 11:
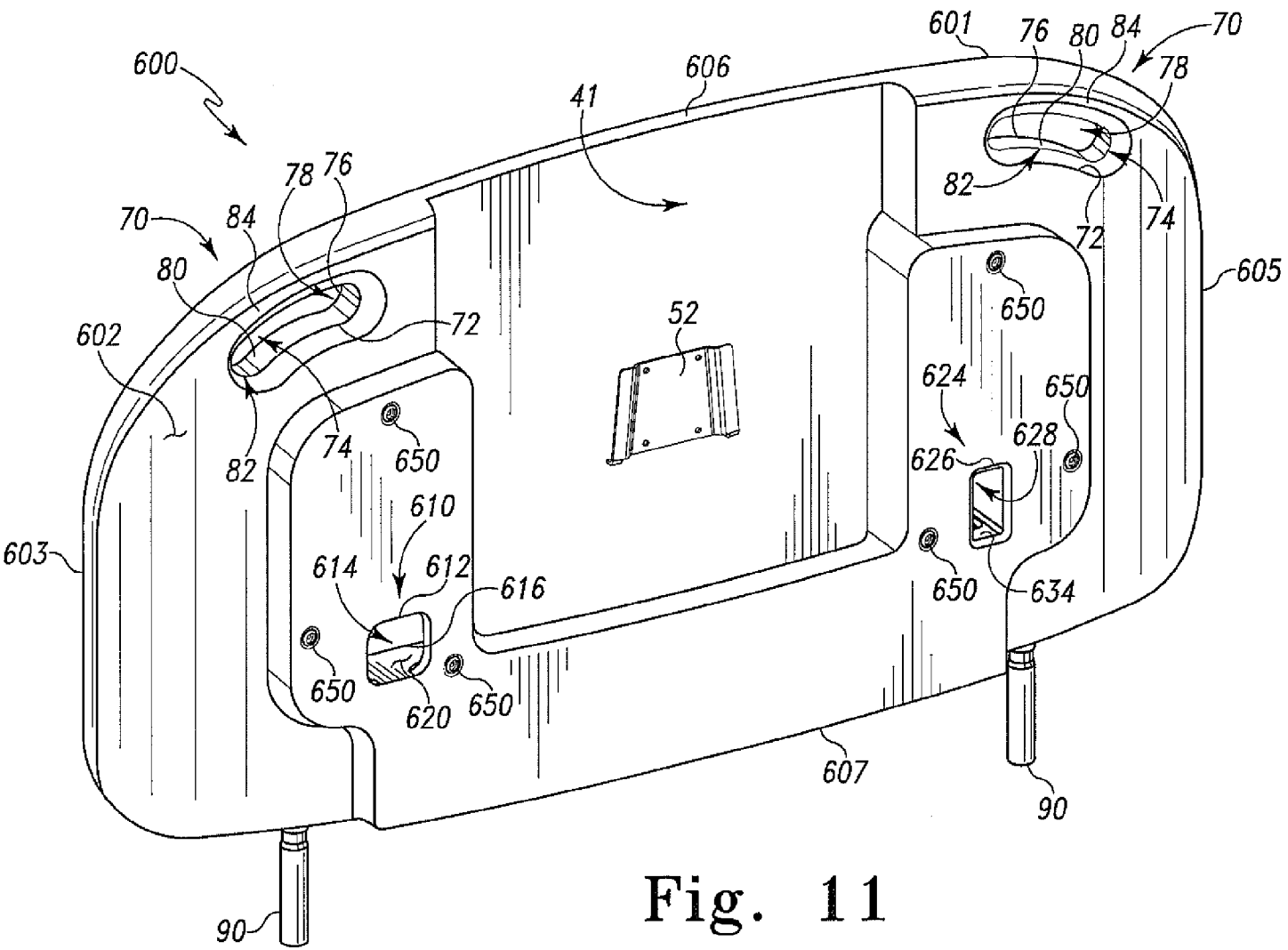
FIG. 11 is a perspective view of another embodiment of an endboard in accordance with the present disclosure including an optional service-supply coupler affixed to a front surface of the endboard.
Figure 18:
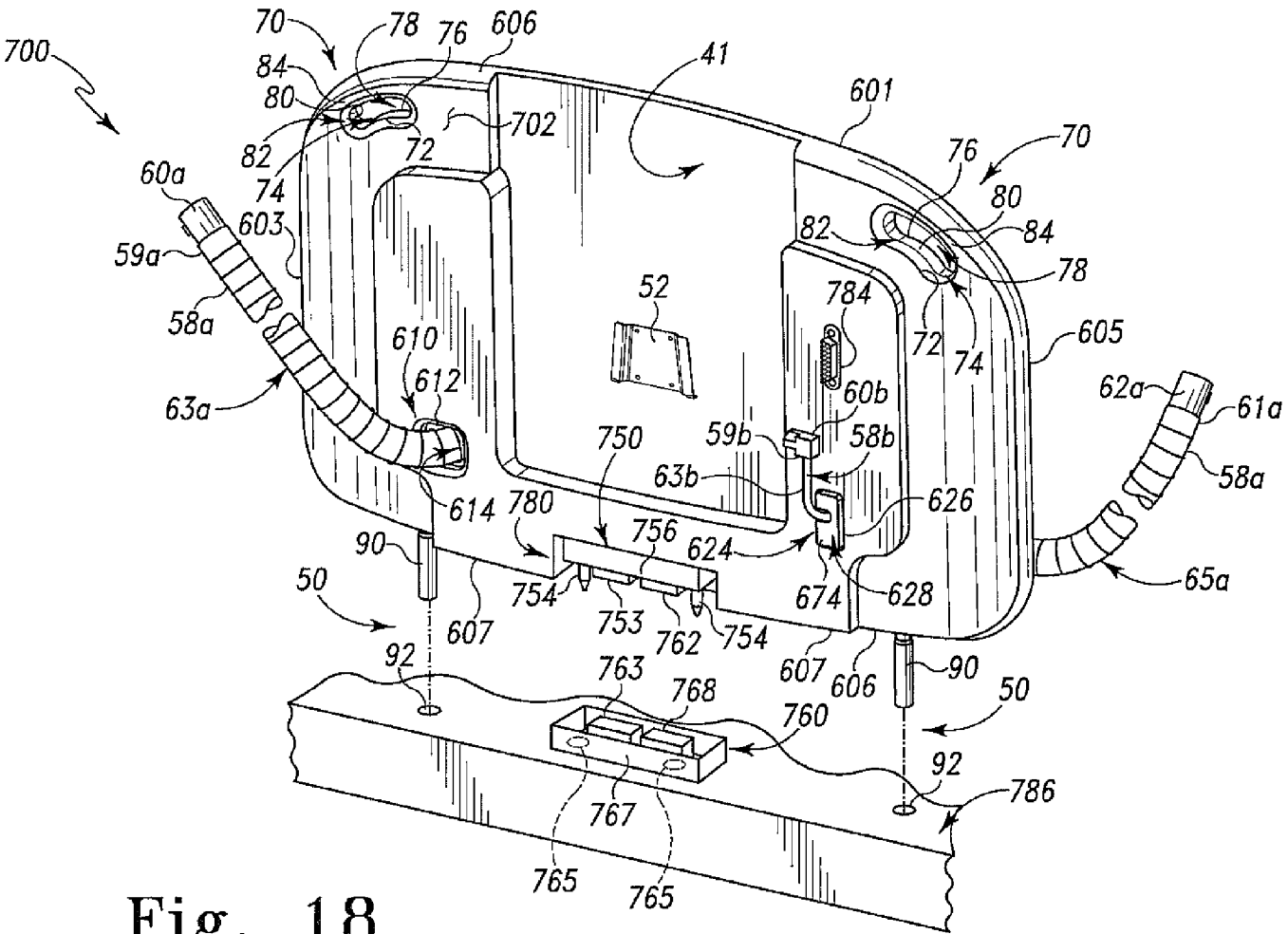
FIG. 18 is a perspective view of a portion of a frame member of a patient support and another embodiment of an endboard in accordance with the present disclosure.

Front surface 102 of endboard 100 includes a service supply mounting region 41 as shown in FIG. 4. Service supply mounting region 41 has a perimeter defining service supply mounting region 41 generally corresponding to a perimeter of service supply 40 when service supply 40 is installed on endboard 100. Each of the illustrated endboards described in this disclosure may include a service supply mounting region 41 as shown in FIGS. 4, 5, 7, 11 and 18. Service supply mounting regions 41 have dimensions that generally correspond to the dimensions of a service supply 40 that may be mounted to the endboard. As shown in FIGS. 11 and 18, service supply mounting regions 41 may include a recessed area sized to receive at least portion of service supply 40. Because service supply 40 may be mounted adjacent either the front surface or the back surface of the endboard, the corresponding service supply mounting region 41 may likewise be located on either the front surface or the back surface of the endboard.

Figure 2:
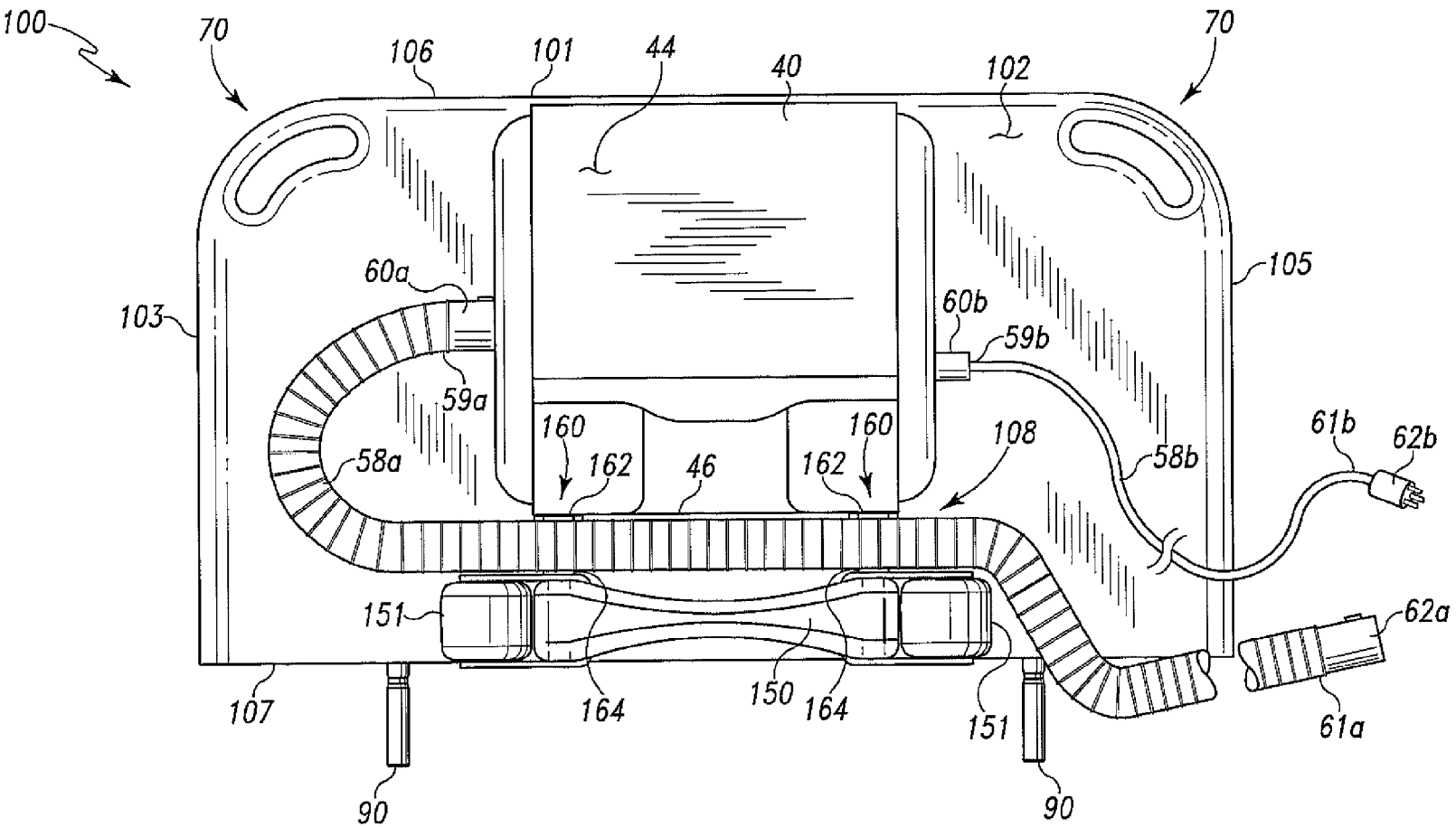
FIG. 2 is a front elevation view of an embodiment of an endboard suitable for use in connection with a patient support, shown supporting a service supply and a hose on a front side of the endboard, the hose being retained by a retainer.

Endboards 38, 100 are releasably coupled to frame 26 using a coupler 50 including first and second mounting posts 90 that are fixed to endboard 100 and extend generally downwardly therefrom as shown, for example in FIG. 2. Mounting posts 90 are received by corresponding openings 92 in frame 26 shown, for example, in FIG. 18, that are configured to receive mounting posts 90. A caregiver wishing to move patient support 20 carrying endboard 100 may apply forces to endboard 100 in directions illustrated by arrows 94 and 95 shown in FIG. 1. Coupler 50 is configured to transmit such forces from endboard 100 to frame 26 without suffering breakage or other failure. However, any coupler suitable for retaining endboard 100 on frame 26 may be used. Additionally, endboard 100 includes one or more handles 70 which may permit a caregiver to lift and manipulate endboard 100, whether endboard 100 is coupled to or decoupled from frame 26.

Endboard 100 includes a shelf 150 extending generally outwardly from a front surface 102 of endboard 100. Bumpers 151 are mounted to shelf 150 for rotation as shown in FIGS. 1-4. Housing 42 of service supply 40 includes a front surface 44 and a bottom surface 46 that cooperates with shelf 150 to define a service-line-receiving space 108 therebetween. Bumpers 151 extend outwardly away from front surface 102 of endboard 100 beyond front surface 44 of housing 42 of service supply 40 to protect service supply 40 from impacts, for example, during transport of patient support 20. While endboard 100 includes bumpers 151, shelf 150 may include any of a variety of bumpers, or may be provided without bumpers.

Shelf 150 is fixed to front surface 102 of endboard 100, as shown in FIGS. 1-4; however, shelf 150 may be pivotably attached to front surface 102. For example, shelf 150 may be attached to front surface 102 by hinges so that shelf 150 pivots upwardly from a use position shown in FIGS. 1-4 to a storage position away from frame 26, having top surface 152 generally parallel to front surface 102 of endboard 100 where it may engage or be received by front surface 102 of endboard 100.

Retainers or line supports 160 are affixed or coupled to front surface 102 of endboard 100 within service-line-receiving space 108 as shown best in FIG. 3; however, retainers 160 may be positioned to lie outside of service-line-receiving space 108. Each retainer 160 is configured to receive a section of hose 58*a* and includes an upper leg 162 and a lower leg 164 spaced apart from upper leg 162 as shown best in FIG. 4. At least one of upper and lower legs 162, 164 of each retainer 160 is yieldably biased toward the other of the upper and lower legs 162, 164 when hose 58*a* is received by retainer 160, so that upper and lower legs 160, 164 cooperate to clasp hose 58*a* when hose 58*a* is received by retainer 160 to resist movement of hose 58*a* away from retainer 160 and away from front surface 102, thereby retaining at least a portion of hose 58*a* in service-line-retaining space 108.

A caregiver wishing to use endboard 100 in accordance with the present disclosure to manage lengths of hose 58*a* while service supply 40 is mounted to endboard 100 may mount service supply 40 to endboard 100, as shown best in FIG. 1. For example, a caregiver may removably couple the mating bracket of housing 42 to service-supply coupler 52 of endboard 100. Caregiver may then couple one end of hose 58*a* to service supply 40 and the other end of hose 58*a* to mattress 28 to operably couple service supply 40 to mattress 28. Caregiver may place a section of hose 58*a* into service-line-receiving space 108, routing hose 58*a* between upper leg 162 and lower leg 164 of one retainer 160 and routing hose 58*a* between upper and lower legs 162, 164 of the other retainer 160 to retain hose 58*a* adjacent retainers 160, thereby retaining at least a section of hose 58*a* within service-line-retaining space 108, as shown best in FIGS. 1 and 2, and resisting movement of hose 58*a* away from front surface 102 of panel 101. Use of endboard 100 in accordance with the present disclosure to support service supply 40 and manage hose 58*a* as provided herein may result in retaining at least a portion of hose 58*a* in a desired space for safety, sanitary, or other reasons.

The composition of a service line may vary depending upon the services conducted by the service line from a service supply to care equipment. For example, a service line may be a hose suitable for conducting medical gases, a hose 58*a*, as shown in FIGS. 1 and 2, suitable for conducting pressurized air, a hose suitable for conducting heated or cooled water or fluid, an insulated hose suitable for conducting heated or cooled water or fluid, an electrical power cord suitable for conducting electrical power, an electrical data cable suitable for conducting an electrical signal, or any other type of service line suitable for conducting the desired service from a service supply to care equipment or one service supply to another. A service line may include two or more lines conducting services from a service supply to care equipment in the event that it is desired to provide two or more services from the service supply to the care equipment. In addition, the service line may include more complex combinations such as, for example, a main hose, a secondary hose, and a data cable, in which both the secondary hose and data cable are located within an inner region of the main hose.

Retainers or line supports 160 may be of various shapes and sizes to accommodate service lines having varying diameters, by varying, for example, the size and shape of upper and lower legs 162, 164, and for another example, by varying the distance by which upper and lower legs 162, 164 of retainer 160 are spaced apart. Retainer 160 may be configured to accommodate small service lines such as fluid capillary tubes. Also, retainer 160 may be configured to accommodate larger service lines such as conduits housing multiple service lines. If desired, a plurality of retainers of varying sizes may be provided on a single endboard to accommodate the retention of a plurality of services lines of varied sizes.

Upper leg 162 and lower leg 164 of retainers or line supports 160 may be integrally formed in front surface 102 of endboard 100. Front surface 102 may be formed to include a recess (not shown) within or adjacent to service-line-receiving space 108 sized to receive one or more service lines 58.

Such a recess may be sized, for example, so that the one or more service lines 58 are retained therein through a friction fit with portions of the front surface 102 defining the recess.

Retainers or line supports 160 are illustratively shown in FIG. 2 as positioned within service-line-receiving space 108. Alternatively, retainers or line supports 160 may be positioned to lie adjacent to service-line-receiving space 108 while remaining effective to retain at least a portion of hose 58*a* within service-line-receiving space 108.

As described above, service supply 40 may be removably mounted adjacent front surface 102 of endboard 100, as shown in FIG. 2, using an optional bracket such as illustrative service-supply coupler 52 fixed to front surface 102 of endboard 100, shown best in FIG. 3, that is configured to mate with a mating bracket (not shown) fixed to housing 42 of service supply 40. Service-supply coupler 52 includes a first leg 54 projecting frontwardly away from front surface 102 of endboard 100 and a second leg 56 projecting frontwardly away from front surface 102 of endboard 100. First leg 54 and second leg 56 angle downwardly from a top edge 53 of service-supply coupler 52 and are configured to engage mating legs (not shown) of the mating bracket fixed to housing 42. The mating bracket of housing 42 includes a first leg (not shown) configured to be received within a space (not shown) defined between first leg 54 and front surface 102. The mating bracket of housing 42 also includes a second leg (not shown) configured to be received within a space (not shown) defined between second leg 56 and front surface 102 to couple the mating bracket to service-supply coupler 52 and thereby couple service supply 40 to endboard 100.

Figure 5:
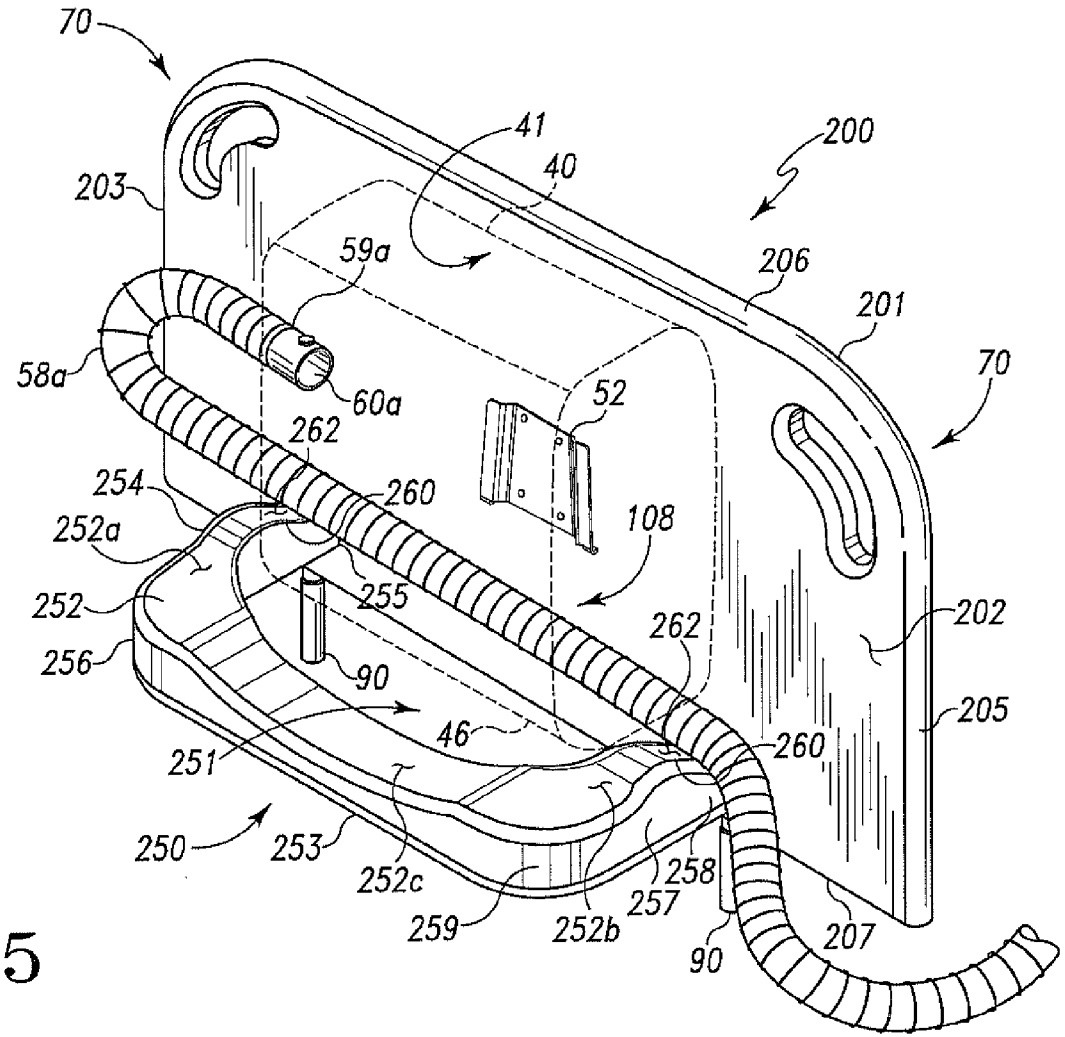
FIG. 5 is a perspective view of another embodiment of an endboard in accordance with the present disclosure supporting a service supply (shown in phantom) and a hose, the endboard including a shelf configured to retain the hose.
Figure 6:
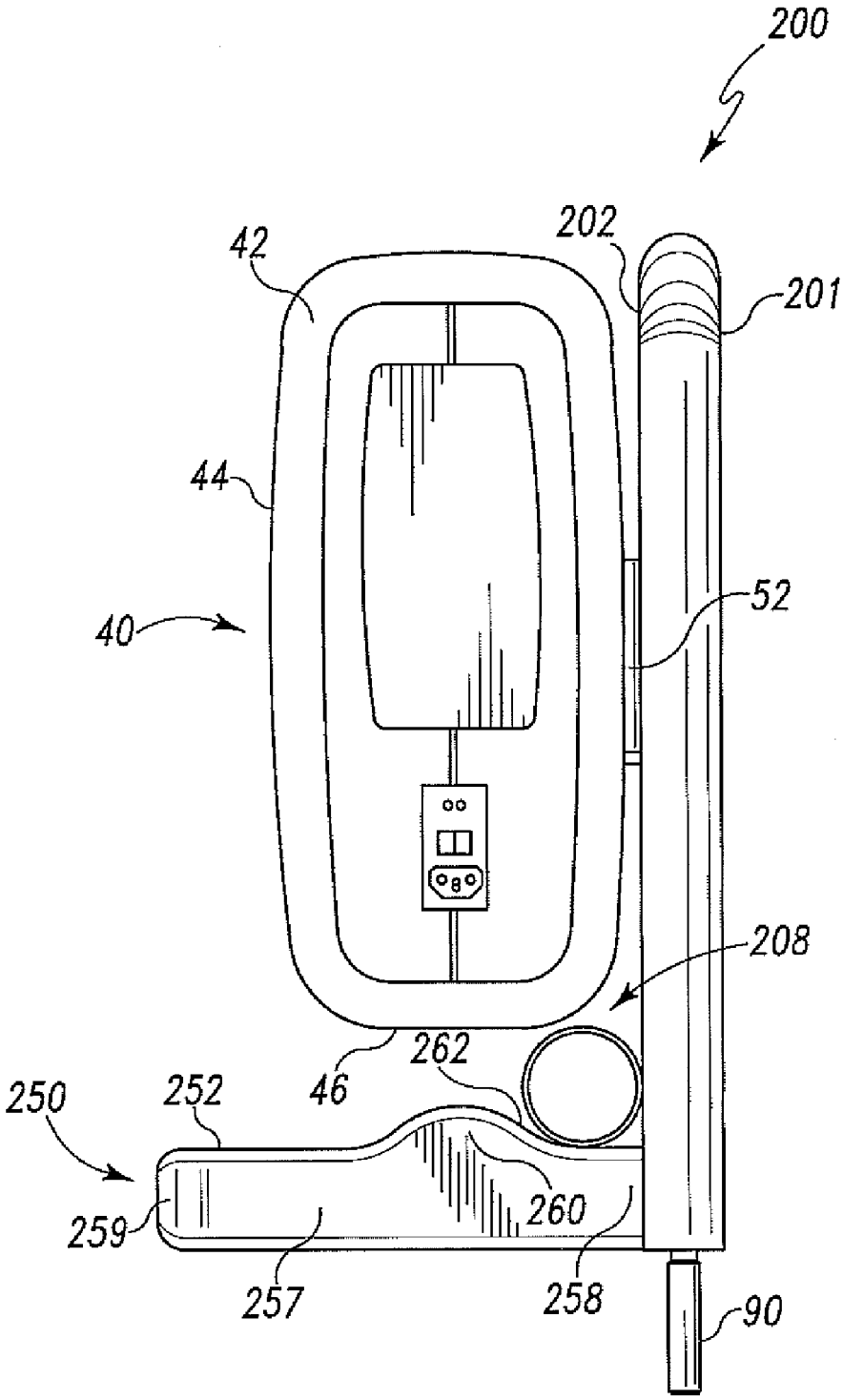
FIG. 6 is an end elevation view of the endboard, service supply, and hose of FIG. 5 showing a hose retainer including a stop.

Another embodiment of an endboard 200 includes retainers or line supports 260 as shown in FIGS. 5 and 6. A shelf 250 of endboard 200 is formed to include a top surface 252. Retainers 260 are integrally appended to shelf 250 and include a portion of top surface 252 that forms stops 262 of retainers 260.

Shelf 250 includes a first leg 254 having a first end 255 fixed to a front surface 202 of endboard 200 and a second end 256 extending frontwardly away therefrom as shown in FIG. 5. Shelf 250 also includes a second leg 257 having a first end 258 coupled to front surface 202 of endboard 200 and a second end 259 extending frontwardly away therefrom. A front member 253 is integrally appended to and extends between the second ends 256, 259 of first and second legs 254, 257. Front surface 202 of endboard 200, first leg 254, second leg 257, and front member 253 cooperate to define an opening 251 in shelf 250.

First leg 254 includes a top surface 252*a*, second leg 257 includes a top surface 252*b*, and front member 252*c* includes a top surface 252*c*, as shown in FIG. 5. Top surfaces 252*a*, 252*b*, 252*c* cooperate to define top surface 252 of shelf 250. Retainers 260 are integrally appended to first leg 254 and second leg 257 so that retainers 260 include a portion of top surfaces 252*a* and 252*b*, respectively, and each retainer 260 includes at least one stop 262. First leg 254 and second leg 257 are each formed to include retainers 260. A portion of top surfaces 252*a*, 252*b* are formed to include at least one stop 262 of retainers 260. Front surface 202 of endboard 200 cooperates with stops 262 and top surface 252 to define a service-line-receiving space 208, as shown in FIG. 6.

A caregiver may use endboard 200 to manage lengths of service lines while service supply 40 is mounted to endboard 200 and service supply 40 is operably coupled to care equipment. For example, service supply 40 may be mounted to endboard 200 and service supply 40 may be operably coupled to mattress 28 by hose 58*a*, as shown in FIGS. 5 and 6.

A caregiver wishing to supply pressurized air to mattress 28 may mount service supply 40 to endboard 200 using optional service-supply coupler 52 or other methods as previously described. The caregiver may couple one end of hose 58*a* to service supply 40 and the other end of hose 58*a* to mattress 28. The caregiver may then place a section of hose 58*a* into service-line-receiving space 208, including placing a section of hose 58*a* between one retainer 260 and front surface 202, and placing a separate section of hose 58*a* between the other retainer 260 and front surface 202. When hose 58*a* is received by service-line-receiving space 208, stops 262 engage hose 58*a* to resist movement of hose 58*a* away from front surface 200, thereby retaining hose 58*a* within service-line-receiving space 208.

Shelf 250 is generally formed to include opening 257 such that top surface 252 is discontinuous thereby resulting in the formation of two distinct stops 262. However, top surface 252 may be continuous and formed to include no opening therethrough. In such configuration, one retainer forming one stop in the top surface may be provided. Such stop may extend along the entire length of the top surface of the shelf or along only a portion thereof. Alternatively, a plurality of stops may be provided if desired. Likewise, while shelf 250 generally includes first and second legs 254, 257 and is formed to include an opening therebetween, additional legs may be provided extending between front surface 202 and front member 253, and cooperating with the first and second legs 254, 257 and front member 253 to define a plurality of openings through the shelf 250. Retainer 260 and stop 262 may be provided on only one leg, on more than one leg but on less than every leg, or retainers 260 and stops 262 may be provided on each leg.

Figure 7:
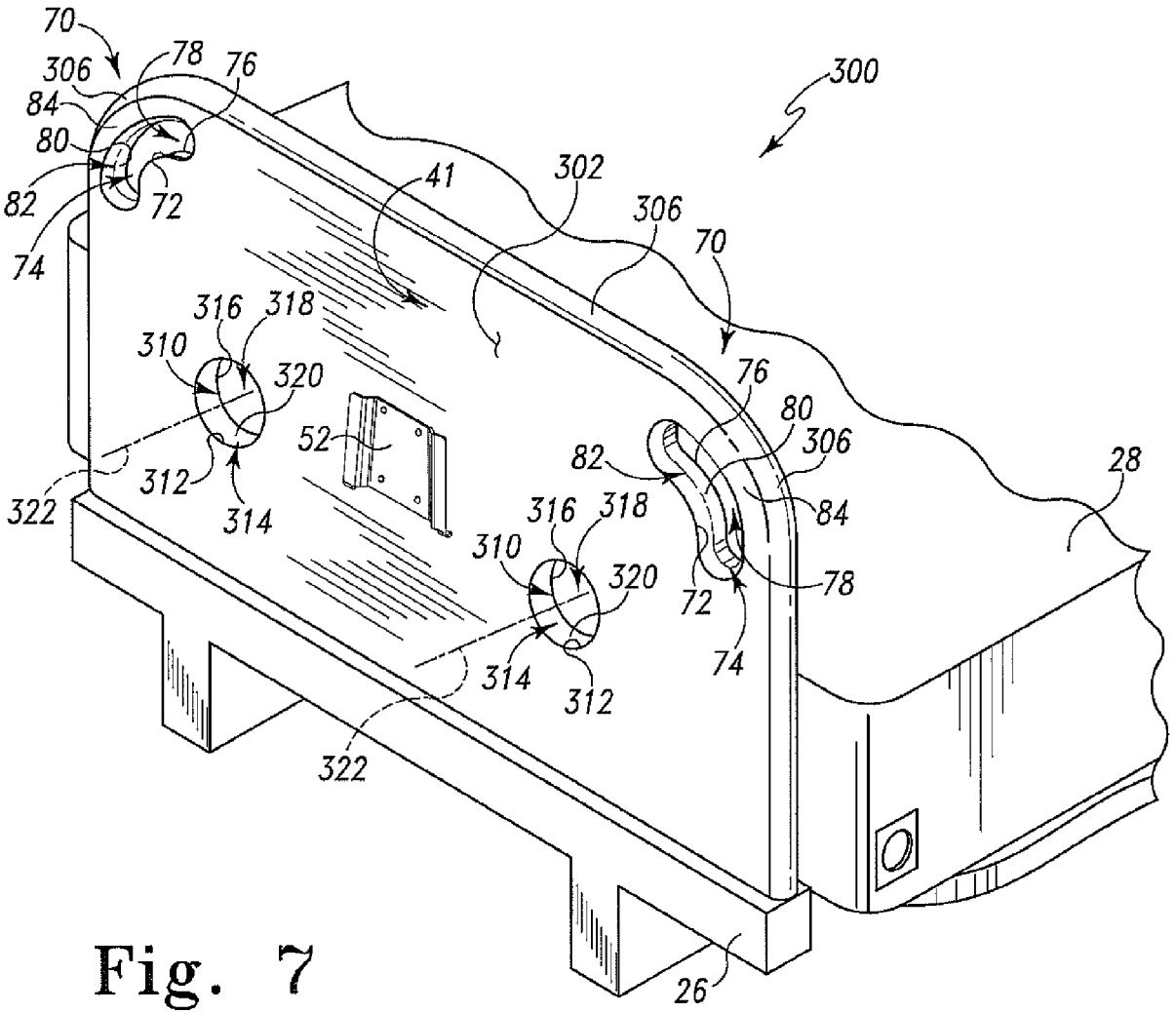
FIG. 7 is a perspective view of a portion of a patient support including another embodiment of an endboard in accordance with the present disclosure coupled to a bed frame, the endboard including apertures extending therethrough.
Figure 8:
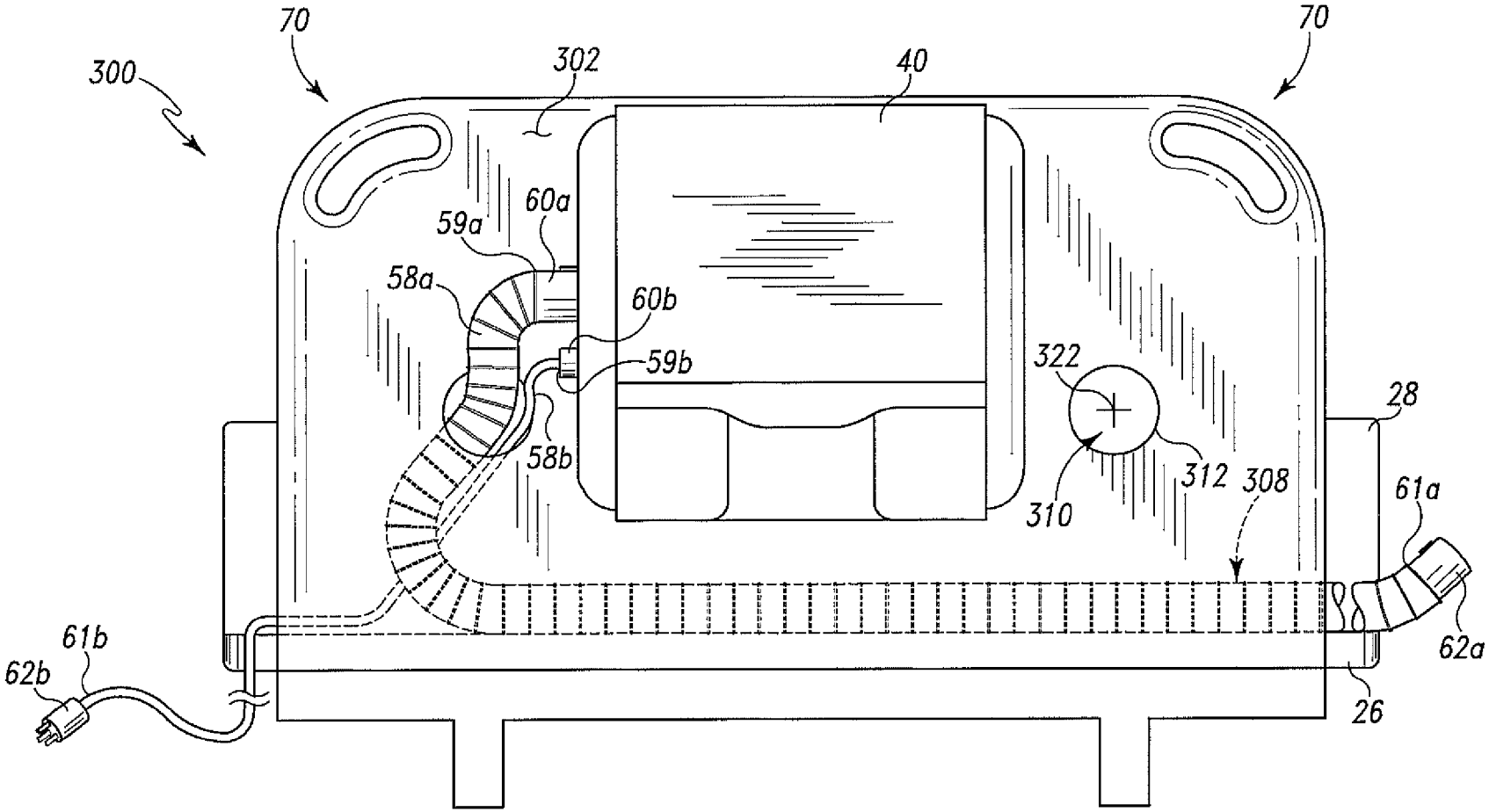
FIG. 8 is a front elevation view of the endboard of FIG. 7 supporting or carrying a service supply and showing a portion of a first service line that is a hose and a portion of a second service line that is an electrical power cable.

Another embodiment of an endboard 300 is shown in FIGS. 7 and 8. Endboard 300 includes a front surface 302 and a back surface (not shown), and endboard 300 is provided with optional service-supply coupler 52 mounted to front surface 302 as previously described in connection with FIGS. 1-6. Endboard 300 is formed to include handles 70.

Each handle 70 of endboard 300 includes a portion of front surface 302 formed to include a first edge 72 defining a first opening 74. The back surface is likewise formed to include an edge 76 defining an opening 78 on the back surface corresponding to opening 74 and cooperating therewith to form a finger space 82 extending through endboard 300. A handle surface 80 extends between edges 72, 76 and cooperates therewith to define finger space 82. A grip 84 is defined between finger space 82 and a top 306 of endboard 300 as shown best in FIG. 7. Thus, each handle 70, includes grip 84 integrally formed in endboard 300 and finger space 82 defining grip 84. A caregiver wishing to lift or manipulate endboard 300 may grasp grips 84 such that the caregiver's fingers may extend into finger spaces 82 to securely hold endboard 300.

In addition, while handles 70 of endboard 300 include grips 84 integrally formed in endboard 300 and finger spaces 82 formed therein, other embodiments of endboards may be provided without handles, or may be provided with handles fixed, integrally formed, coupled, or cantilevered to one or more of front surface 302, back surface, and top 306 of endboard 300, or may be provided with any other suitable handle permitting a caregiver to grasp endboard 300 or to lift and manipulate endboard 300.

Endboard 300 may include two handles 70 each of which is sized and positioned on endboard 300 to permit a caregiver to securely lift and manipulate endboard 300. For example, openings 74, 78 are positioned near top 306 of endboard 300 so that grips 84 are large enough to retain their integrity when a caregiver lifts or manipulates endboard 300 while grasping grips 84. In addition, openings 74, 78 are positioned near top 306 so that grip 84 is small enough to permit a caregiver's fingers to securely grasp grips 84. Further, openings 74, 78 are sized and handle surface 80 is configured so that a caregiver's fingers may fit within finger space 82 permitting a caregiver to securely grasp grips 84 when the caregiver lifts or manipulates endboard 300. Likewise, handle surface 80 and edges 72, 76 are configured to provide a smooth comfortable space, free from obstructions, for the caregiver's fingers. If desired, surface 302 along grips 84 may be textured or shaped to improve the caregiver's ability to grasp grips 84.

Endboard 300 includes channels 310 configured to receive one or more service lines 58 such as air hose 58*a* and cable 58*b* as shown in FIG. 8. Front surface 302 of endboard 300 includes second edges 312 defining channel openings 314 of each channel 310. The back surface is likewise formed to include edges 316, each defining an opening 318 corresponding to each channel opening 314. Channel surfaces 320 extend through endboard 300 between edges 312, 316 and cooperate therewith to define channels 310 extending through endboard 300 generally along channel axes 322. Each channel axis 322 extends in a direction generally perpendicular to front surface 302.

Endboard 300 includes two channels 310; however, an endboard according to the present disclosure may include one channel 310, or may include more than two channels 310. Each channel 310 is sized and positioned on or within endboard 300 to accommodate one or more service lines 58 such as hose 58*a* as shown in FIG. 8. Illustrative channels 310 are positioned away from top 306 of endboard 300 so that at least one channel 310 is near the outlet (not shown) of service supply 40 where first hose connector 60*a* of hose 58*a* is operatively coupled to service supply 40. Channel 310 may be positioned in numerous locations on endboard 300 provided that at least a portion of opening 314 is not obstructed by housing 42 of service supply 40 and provided that opening 314 is suitably near the outlet (not shown) of service supply 40.

Illustrative first and second channel openings 314, 318 are generally circular; however, channel openings 314, 318, and channel 310, may be of various sizes or shapes to accommodate service lines 58 and their respective connectors having varying diameters and shapes. For example, channel openings 314, 318, and channels 310 may have rectangular shapes and cross-sections to accommodate a plurality of juxtaposed cables. Thus, the size, shape, and positions of channel openings 314, 318, and channels 310 may be configured to accommodate the number, size, shape, and other requirements of service lines anticipated for use with endboard 300, as well as the number and type of service supplies 40 anticipated for use with endboard 300.

Routing configurations for service line 58 may be selected by the caregiver based upon several considerations, including, inter alia, the length, size and number of service lines extending between service supply 40 and the care equipment, the placement or mounting configuration of service supply 40, or placement or mounting of the care equipment.

A caregiver may wish to use endboard 300 to manage or direct service lines 58 such as hose 58*a* and cable 58*b* within a service-line-receiving space 308, as shown in FIG. 8, between care equipment such as a mattress (not shown) and service supply 40, and/or within one or both of channels 310, which are likewise service-line-receiving spaces. In such system, channel surfaces 320 and/or edges 312, 316 may engage service lines 58 and operate as line supports when service lines 58 are received in channels 310 preventing or resisting movement of service lines 58 away from one or more service-line-receiving spaces.

The caregiver may mount service supply 40 to service-supply coupler 52 of endboard 300. The caregiver may route a section of hose 58*a* into one or both of channels 310. For example, a first end 59*a* of hose 58*a* may be operatively coupled to service supply 40 by a hose connector 60*a* and a second end 61*a* of hose 58*a* may be routed from front surface 302, through endboard 300 past opening 314, through channel 310, past opening 318, and extending to a position past the back surface (not shown) of endboard 300. Hose 58*a* thereafter (as shown in phantom in FIG. 8) may extend along a service-line-receiving space 308 defined by back surface (not shown), frame 26, and mattress 28. The caregiver may then operably couple a hose connector 62*a* on second end 61*a* of hose 58*a* to the mattress (not shown). When hose 58*a* is received by channel 310, at least a portion of hose 58*a* is retained by the channel surface 320 and by at least one of edges 312, 316.

As described above, portions of channels 310 of endboard 300 may engage one or more service lines 58 and may operate as line supports, as may portions of edges 312, 316. In addition, various routing configurations of service lines 58 through channels 310 may prove advantageous. For example, a caregiver may pass hose 58*a* through more than one channel 310. A caregiver may choose to utilize a "serpentine" routing of hose 58*a* by which first hose connector 60*a* of hose 58*a* is operatively coupled to service supply 40 and second end 61*a* of hose 58*a* is routed from front surface 302 of endboard 300 through a first channel 310 to extend past the back surface of endboard 300. The caregiver may then route the second end 61*a* adjacent to the back surface of endboard 300, through another channel 310 to extend past front surface 302 of endboard 300, so that a section of hose 58*a* is located adjacent the back surface of endboard 300. The caregiver may then operably couple hose connector 62*a* on second end 61*a* of hose 58*a* to mattress 28, thereby utilizing a portion of the back surface between openings 318 as a service-line-receiving space.

While channel axes 322 of channels 310 extend in a direction generally perpendicular to front surface 302, axis 322 of at least one channel 310 may extend in a direction that is not generally perpendicular to front surface 302 of endboard 300. Such non-orthogonal routing may be provided, for example, to permit routing a larger portion of service line within an endboard when extending from a service supply to care equipment, to direct service line 58 to a desired location, or to avoid or minimize bending a service line that may be fragile, stiff, or have a large diameter.

Figure 9:
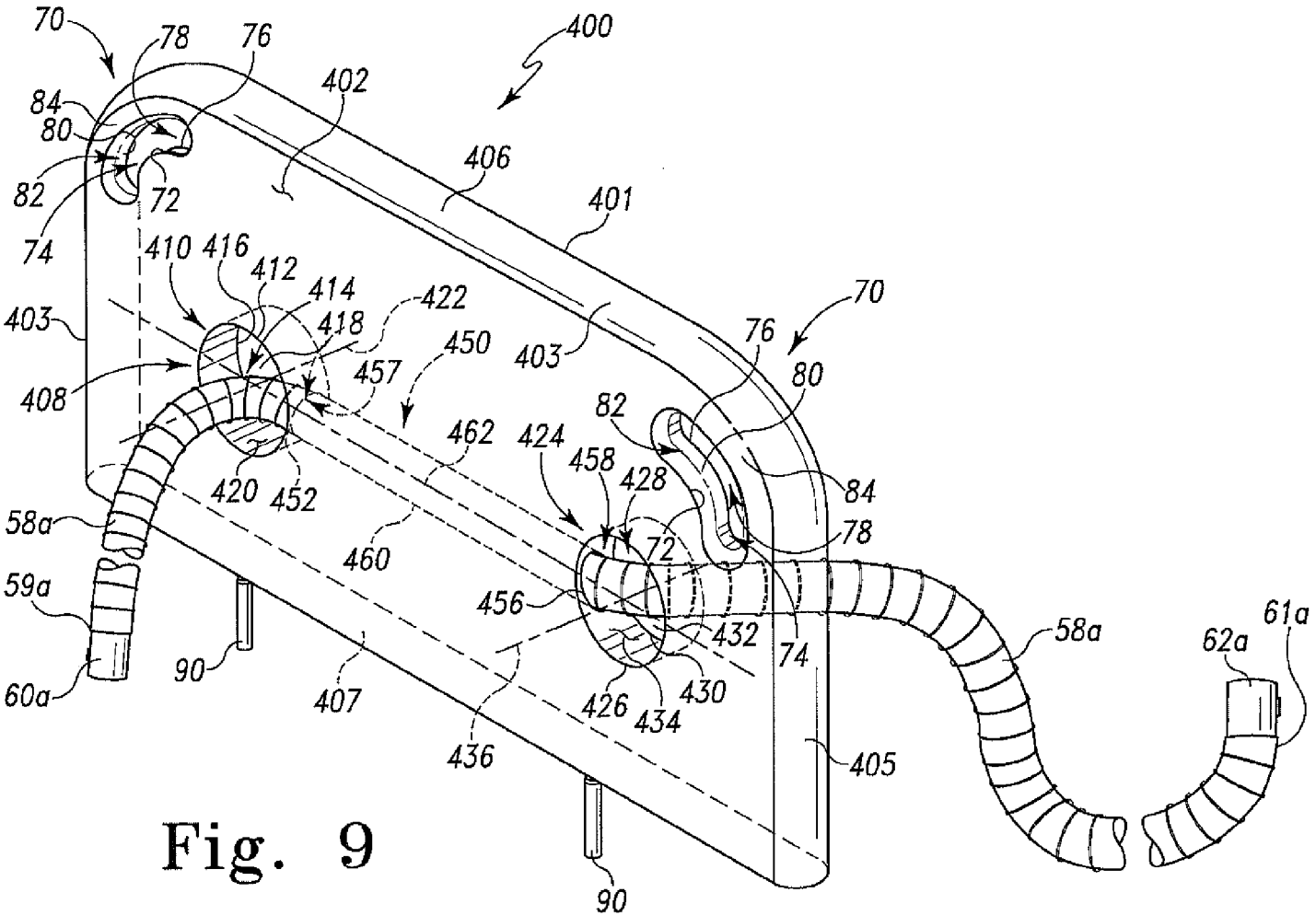
FIG. 9 is a perspective view of another embodiment of an endboard in accordance with the present disclosure including channel openings extending therethrough, and a channel (shown in phantom) formed within an interior region of the endboard and having a service line extending therethrough.

Another embodiment of an endboard 400 is shown in FIG. 9. Endboard 400 includes a housing 401 having a front surface 402, a back surface (not shown), a bottom 407, a top 406 extending upwardly from bottom 407, a first end 403, and a second end 405. Front surface 402 and the back surface of endboard 400 are spaced apart by a depth of endboard 400. Top 406 and bottom 407 are spaced apart by a height of endboard 400. First end 403 and second end 405 are spaced apart by a width of endboard 400. Front surface 402 and the back surface cooperate to define an interior region of endboard 400.

Housing 401 includes handles 70, as shown in FIG. 9, including a portion of front surface 402 formed to include a first edge 72 defining first opening 74, as previously described in connection with other embodiments of endboards. The back surface is likewise formed to include edge 76 defining opening 78 on the back surface corresponding to opening 74 and cooperating therewith to form finger space 82 extending through endboard 400. Handle surface 80 extends between edges 72, 76 and cooperates therewith to define finger space 82. Grip 84 is defined between finger space 82 and top 406 of endboard 400. Thus, each handle 70, includes grip 84 integrally formed in endboard 400 and finger space 82 defining grip 84. A caregiver wishing to lift or manipulate endboard 400 may grasp grips 84 such that the caregiver's fingers may extend into finger spaces 82 to securely hold endboard 400.

Endboard 400 includes channels 410, 424, and 450 configured to receive one or more service lines such as hose 58*a* as shown in FIGS. 9. Front surface 402 of endboard 400 includes edge 412 defining first channel opening 414 of channel 410. The back surface is likewise formed to include an edge 416, defining an opening 418 corresponding to channel opening 414. Channel surface 420 extends through endboard 400 between edges 412, 416 and cooperates therewith to define channel 410 extending through endboard 400 generally along channel axis 422. Channel axis 422 extends in a direction generally perpendicular to front surface 402.

Additionally, front surface 402 of endboard 400 includes edge 426 defining third channel opening 428 of channel 424. The back surface is likewise formed to include an edge 430, defining an opening 432 corresponding to channel opening 428. Channel surface 434 extends through endboard 400 between edges 426, 430 and cooperates therewith to define channel 424 extending through endboard 400 generally along channel axis 436. Channel axis 436 is generally perpendicular to front surface 402.

Channel surface 420 of first channel 410 includes edge 452 defining a fifth channel opening 457 of third channel 450. Channel surface 434 of second channel 424 is likewise formed to include an edge 456, defining a sixth channel opening 458 corresponding to fifth channel opening. A channel surface 460 (shown in phantom) extends through endboard 400 between edges 452, 456 and cooperates therewith to define third channel 450 extending through endboard 400 generally along channel axis 462. Channel axis 462 is generally parallel to front surface 402. A service-line-receiving space 408 of endboard 400 is cooperatively defined by first, second and third channels 410, 424, and 450.

A caregiver may wish to use endboard 400 to manage or direct service lines 58 such as hose 58*a* within a service-line-receiving space 408, as shown in FIG. 9, between care equipment such as a mattress (not shown) and a service supply (not shown). In such system, one or more of channel surfaces 420, 434, and 460 and/or edges 412, 416, 426, 430, 452, and 456, may engage service lines 58 and operate as line supports when service lines 58 are received in channels 410, 424, and 450 preventing or resisting movement of service lines 58 away from service-line-receiving space 408.

A caregiver wishing to operably couple care equipment (not shown) to a service supply (not shown) and manage hose 58*a* extending therebetween may mount the service supply to housing 401 of endboard 300. The caregiver may, for example, pass second end 61*a* of hose 58*a* from a position in front of endboard 400, past first channel opening 414 formed in front surface 402 of endboard 400 into first channel 410, through fifth channel opening 457 formed in channel surface 420 into channel 450, through third channel 450, through sixth channel opening 458 formed in channel surface 434, and into second channel 424. Caregiver may continue to extend second end 61*a* of hose 58*a* through fourth channel opening 432 formed in the back surface of endboard 400 so that second end 61*a* and a portion of hose 58*a* extends past the back of endboard 400.

Once hose 58*a* is positioned as described and as shown in FIG. 9, having at least a portion of hose 58*a* received in service-line-receiving space 408, the caregiver may couple first and second hose connectors 60*a*, 62*a*, respectively, to the care equipment and the service supply. Thus, at least a portion of hose 58*a* is received in service-line-receiving space 408 and movement of hose 58*b* away from service-line-receiving space 408 is prevented or resisted by at least one or more of channel surfaces 420, 434, and 460 and/or edges 412, 416, 426, 430, 452, and 456.

Thus, as described above, portions of channel surfaces 420, 434, and 460 may engage one or more service lines 58 and thus may operate as line supports. Likewise, as may portions of edges 412, 416, 426, 430, 452, and 456 may engage one or more service lines 58 and thus may operate as line supports. In addition, various routing configurations of service lines 58 through channels 410, 424, and 450 may prove to be advantageous. For example, a caregiver may pass second end 61*a* of hose 58*a* from a position in front of endboard 400, past first channel opening 414 formed in front surface 402 of endboard 400 into first channel 410, through fifth channel opening 457 formed in channel surface 420 into channel 450, through third channel 450, through sixth channel opening 458 formed in channel surface 434, and into second channel 424. Caregiver may continue to pass second end 61*a* of hose 58*a* through third channel opening 428 formed in the front surface of endboard 400 so that second end 61*a* and a portion of hose 58*a* extends past the front of endboard 400. Caregiver may then continue by passing second end 61*a* of hose 58*a* once again past first channel opening 414 formed in front surface 402 of endboard 400, through first channel 410, and through second channel opening 418 formed in the back surface of endboard 400 so that second end 61*a* and a portion of hose 58*a* extends past the back of endboard 400. The caregiver may then operably couple hose connector 62*a* on second end 61*a* of hose 58*a* to mattress 28, thereby utilizing a portion of the front surface between openings 414, 428 as a service-line-receiving space.

While channel axes 422, 436 of channels 410, 424 extend in a direction generally perpendicular to front surface 302, at least one of axes 422, 436 may extend in a direction that is not generally perpendicular to front surface 402 of endboard 400. Furthermore, while channel axis 462 of channel 450 extends in a direction generally parallel to front surface 402, channel axis 462 may extend in a direction that is not generally perpendicular to front surface 402 of endboard 400.

Figure 10:
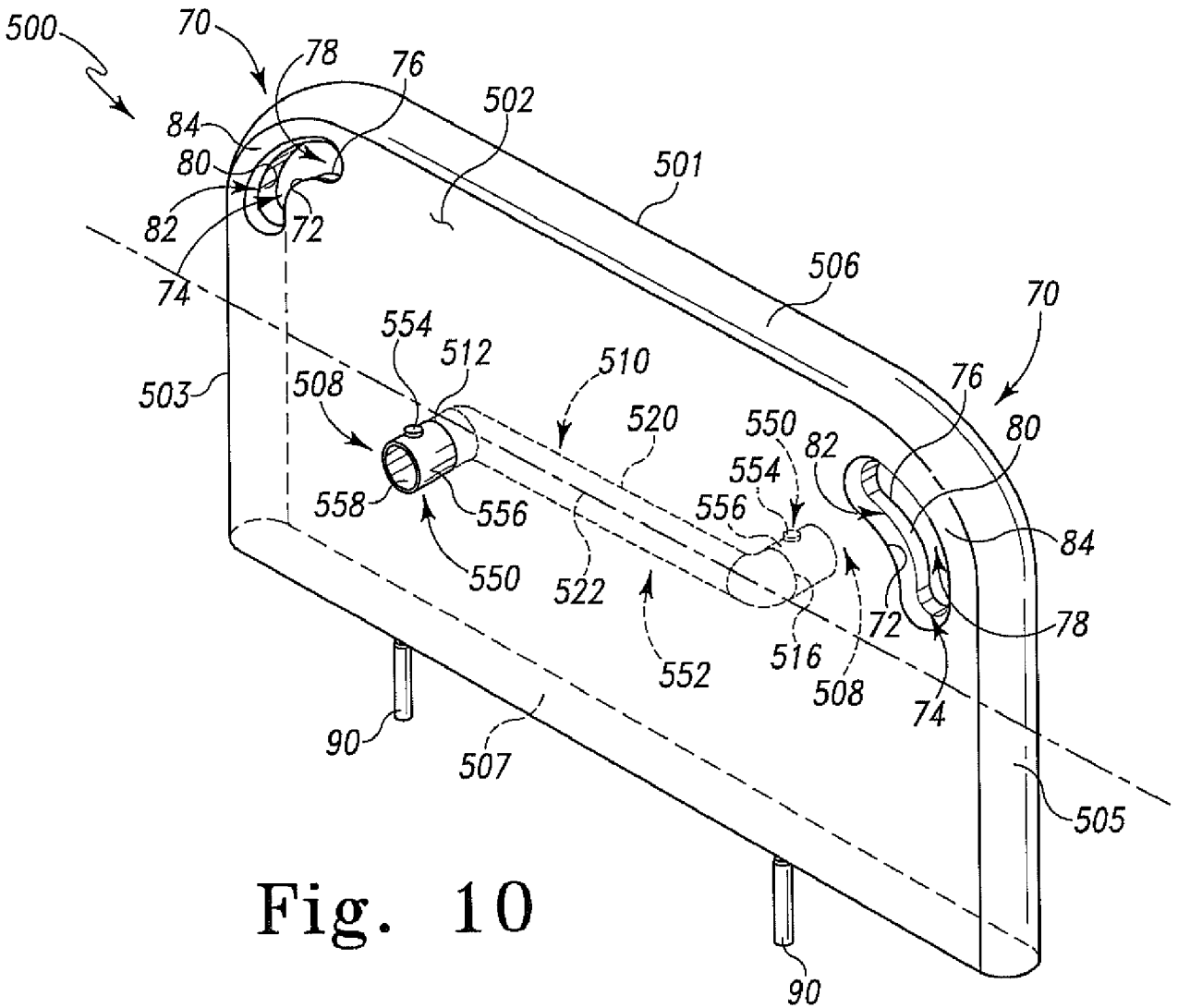
FIG. 10 is a perspective view of another embodiment of an endboard in accordance with the present disclosure showing a hose coupler mounted to a front surface of the endboard, a second hose coupler (shown in phantom) mounted to a back surface of the endboard, and a channel (shown in phantom) extending therebetween.

Another embodiment of an endboard 500 is shown in FIG. 10. Endboard 500 includes a housing 501 having a front surface 502, a back surface (not shown), a bottom 507, a top 506 extending upwardly from bottom 507, a first end 503, and a second end 505. Front surface 502 and the back surface of endboard 500 are spaced apart by a depth of endboard 500. Top 506 and bottom 507 are spaced apart by a height of endboard 500. First end 503 and second end 505 are spaced apart by a width of endboard 500. Front surface 502 and the back surface cooperate to define an interior region of endboard 500.

Housing 501 includes handles 70, as shown in FIG. 10, including a portion of front surface 502 formed to include a first edge 72 defining first opening 74, as previously described in connection with other embodiments of endboards. The back surface is likewise formed to include edge 76 defining opening 78 on the back surface corresponding to opening 74 and cooperating therewith to form finger space 82 extending through endboard 500. Handle surface 80 extends between edges 72, 76 and cooperates therewith to define finger space 82. Grip 84 is defined between finger space 82 and top 506 of endboard 500. Thus, each handle 70, includes grip 84 integrally formed in endboard 500 and finger space 82 defining grip 84. A caregiver wishing to lift or manipulate endboard 500 may grasp grips 84 such that the caregiver's fingers may extend into finger spaces 82 to securely hold endboard 500.

Front surface 502 of endboard 500 includes a first edge 512 defining first channel opening (not shown). The back surface is likewise formed to include an edge 516 (in phantom), defining a second opening (not shown) corresponding to the first channel opening. Channel surface 520 (in phantom) extends through endboard 500 between the first and second edges and cooperates therewith to define a channel 510 extending through endboard 500 generally along channel axis 522. Channel axis 522 extends in a direction generally parallel to front surface 502. A service-line-receiving space is generally defined by channel 510.

First and second hose couplers 550 are provided. Each hose coupler 550 is configured to operably couple with a corresponding one of hose connectors 60*a*, 62*a* on hose 58*a* as shown, for example, in FIG. 9. Illustrative hose couplers 550 include a cylinder 556 defining an interior region 558. Cylinder 556 of first hose coupler 550 is coupled to front surface 502 adjacent first edge 512 and first channel opening (not shown) so that interior region 558 of first hose coupler 550 is in fluid communication with the first and second channel openings and channel 510. Cylinder 556 (in phantom) of second hose coupler 550 (in phantom) is coupled to the back surface adjacent second edge 516 (in phantom) and the second channel opening (not shown) so that interior region (not shown) of second hose coupler 550 is in fluid communication with first hose coupler 550 through the second channel openings of housing 501, channel 510, and the first channel opening. Interior region 558 of first hose coupler 550 cooperates with the first channel opening of front surface 502, channel 510, the second channel opening of the back surface 504, and interior region 558 of second hose coupler 550 to define a service line 552 integral to endboard 500.

First and second hose couplers 550 are each illustratively shown to include a release button 554 radially movable between an inward release position and an outward latch position shown in FIG. 10. Each release button 554 is yieldable biased toward the latch position and is configured to mate with a corresponding one of hose connectors 60*a*, 62*a* on an end 59*a*, 61*a* of a hose 58*a*, as shown, for example, in FIG. 9, to releasably couple hose 58*a* to the respective hose coupler 550. A first hose (not shown) may have a first end (not shown) having a hose connector (not shown) operably coupled to a service supply (not shown) and a second end (not shown) having a hose connector (not shown) operably coupled to first hose coupler 550. A second hose (not shown) may have a first end (not shown) having a hose connector (not shown) operably coupled to second hose coupler 550 and a second end (not shown) having a hose connector (not shown) operably coupled to care equipment so that the service supply is operably coupled to the care equipment through endboard 500.

In this circumstance, the service supply is in fluid communication with care equipment through the first hose, first hose coupler 550, the first channel opening, channel 510, the second channel opening, the second hose coupler 550, and the second hose. Thus, channel 510 defines a portion of the service line between the service supply and the care equipment, and the first hose, channel 510, and the second hose cooperate to define the service line between the service supply and the care equipment. In addition, hose couplers 550 each operate to define a service-line-receiving space 508 adjacent each hose coupler 550.

A caregiver may use endboard 500, as shown in FIG. 10, to manage or direct service lines 58 such as hose 58*a* (shown, for example, in FIG. 1) between a service supply 40 (shown, for example, in FIG. 1) and care equipment such as mattress 28 (shown, for example, in FIG. 1). In such system, first and second hose couplers 550 engage hose 58*a* and operate as line supports when hose connectors 60*a*, 61 are operably coupled to respective hose couplers 550, preventing or resisting movement of service lines 58 away from front surface 502 of housing 501 and preventing or resisting movement of service lines 58 away from front service-line-receiving space 508.

A caregiver wishing to operably couple service supply 40 to mattress 28 may begin by coupling hose connector 60*a* of a first hose (not shown) to service supply 40 and hose connector 62*a* of the first hose to first hose coupler 550 of endboard 500 shown in FIG. 10. The caregiver may then couple hose connector 62*a* of a second hose (not shown) to mattress 28 and hose connector 60*a* of the second hose to second hose coupler 550 coupled to the back surface of endboard 500. To decouple the first hose from first hose coupler 550, a caregiver may press release button 554 of first hose coupler 550 and disengage hose connector 62*a* of the first hose from first hose coupler 550. To decouple the second hose from second hose coupler 550, a caregiver may press release button 554 of second hose coupler 550 and disengage hose connector 60*a* of the second hose from second hose coupler 550.

As previously described, a service supply may manage or provide, among others, any one or any combination of services and service supplies for those services may be packaged together into one housing or may be provided in separate housings. In additions, the term "service supply" may include other sources for the supply of services, including, for example, sources of services accessible from outlets associated with the walls, ceiling, and/or floor of a room, with a headwall, with a column, and with a boom arm. Thus, while illustrative hose couplers 550 are compatible with an air hose, first and second hose couplers 550 may be configured to couple with service lines for any services available from a service supply.

Hose couplers 550 may be coupled to endboard 500 by screws, nuts and bolds, latches, threaded connectors mating with the endboard surface, adhesives, or the like. In addition, hose couplers 550 may be pressed fit into endboard 500 or provided with a flanged bushing to interface with an endboard surface wall.

Another embodiment of an endboard 600 is shown in FIG. 11-17. Endboard 600 includes a housing 601 having a front surface 602, a back surface 604, a bottom 607, a top 606 extending upwardly from bottom 607, a first end 603, and a second end 605. Front surface 602 and back surface 604 are spaced apart by a depth of endboard 600. Top 606 and bottom 607 are spaced apart by a height of endboard 600. First end 603 and second end 605 are spaced apart by a width of endboard 600. Front surface 602 and back surface 604 cooperate to define an interior region of endboard 600.

Housing 601 includes handles 70, as shown in FIG. 11, including a portion of front surface 602 formed to include first edge 72 defining first opening 74, as previously described in connection with other embodiments of endboards. Back surface 604 is likewise formed to include edge 76 defining opening 78 on back surface 604 corresponding to opening 74 and cooperating therewith to form finger space 82 extending through endboard 600. Handle surface 80 extends between edges 72, 76 and cooperates therewith to define finger space 82. Grip 84 is defined between finger space 82 and top 606 of endboard 600. Thus, each handle 70, includes grip 84 integrally formed in endboard 600 and finger space 82 defining grip 84. A caregiver wishing to lift or manipulate endboard 600 may grasp grips 84 such that the caregiver's fingers may extend into finger spaces 82 to securely hold endboard 600.

Endboard 600 is releasably coupled to frame 26 using a coupler 50 including first and second mounting posts 90 that are fixed to endboard 600 and extend generally downwardly therefrom as shown, for example, in FIG. 18. Mounting posts 90 are received by corresponding openings 92 in frame 26 that are configured to receive mounting posts 90. As discussed in connection with previous embodiments, endboard 600 may be provided with optional service-supply coupler 52 that is attached to front side 602 of endboard 600 shown in FIGS. 11 and 16. Service supply 40 may be removably coupled to endboard 600 using optional service-supply coupler 52 as shown, for example, in FIGS. 13 and 14.

Figure 16:
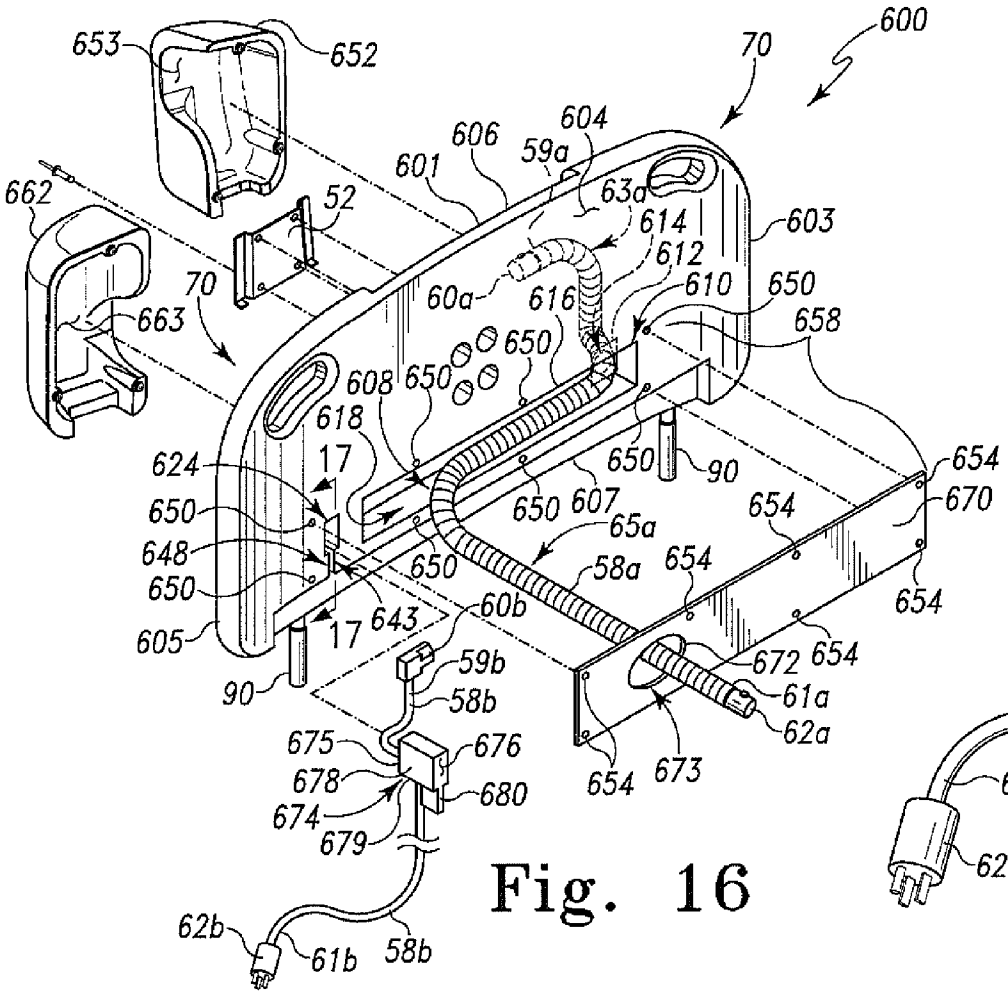
FIG. 16 is an exploded perspective view of the endboard of FIG. 15.

Endboard 600 includes channels 610 and 624 configured to receive one or more services lines such as hose 58*a* and cable 58*b*, as shown best in FIG. 16. Front surface 602 of endboard 600 includes an edge 612 defining a first channel opening 614 of channel 610 as shown, for example, in FIG. 11. Back surface 604 is likewise formed to include an edge 616 defining a second channel opening 618 corresponding to first channel opening 614, as shown best in FIG. 12. A channel surface 620 extends through endboard 600 between edges 612 and 616 and cooperates therewith to define a channel 610 extending through endboard 600.

Additionally, front surface 602 of endboard 600 includes an edge 626 defining a third channel opening 628 as shown, for example, in FIG. 11. Back surface 604 is likewise formed to include an edge 630, defining a fourth channel opening 632 corresponding to third channel opening 628, as shown best in FIG. 12. A channel surface 634 extends through endboard 600 between edges 626 and 630 and cooperates therewith to define channel 624.

Figure 12:
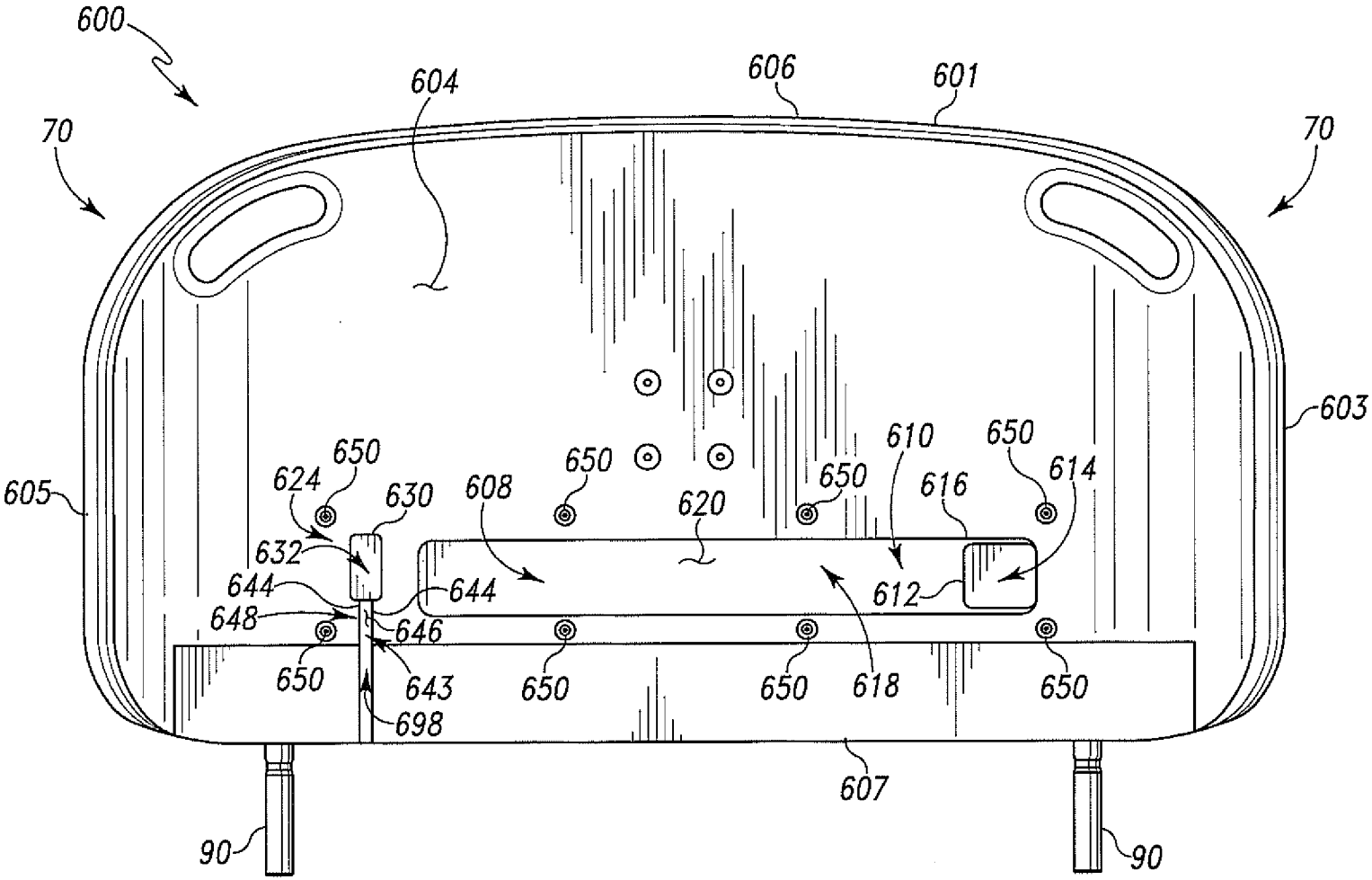
FIG. 12 is an elevation view of a back surface of the endboard of FIG. 11.
Figure 17:
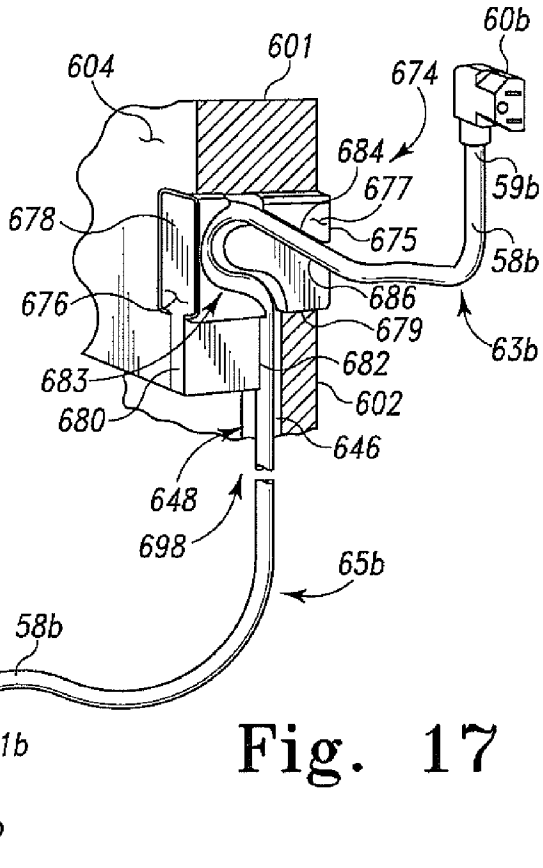
FIG. 17 is a sectional view taken along line 17-17 of FIG. 16 showing the electrical power cable and a retainer for the electrical power cable.

Back surface 604 of endboard 600 further includes slot edges 644 contiguous with edge 630 of back surface 604 as shown best in FIG. 12. Slot edges 644 cooperate to define a slot opening 643 in back surface 604 that is contiguous with fourth channel opening 632. Endboard 600 is further provided with a stop surface 646 spaced apart from back surface 604 as shown in FIGS. 12 and 17. Slot surfaces 642 extend from slot edges 644 to stop surface 646 and cooperate therewith to define a slot 648 that is contiguous with channel 624. Channel 624 and slot 648 cooperate to define a service-line-receiving space 698.

Endboard 600 is provided with a retainer 674 shown best in FIGS. 16 and 17. Retainer 674 includes a main body 678 and has a stop tab 680 extending generally downwardly therefrom. As shown best in FIG. 17, main body 678 is configured to be received by channel 624 and stop tab 680 is configured to be received by slot 648 so that retainer 674 is received by service-line-receiving space 698.

Main body 678 of retainer 674 includes a grooved surface 677 and a back surface 676 generally coplanar with back surface 604 of housing 601 when retainer 674 is installed in housing 601 as shown best in FIG. 17. Grooved surface 677 includes a first edge 684 and a second edge 686 that is spaced apart from first edge 684 and cooperates therewith to define a serpentine groove 683. Groove 683 extends from a front surface 675 of main body 678 to a bottom surface 679 of main body 678. Stop tab 680 includes a frontwardly-facing service-line-engaging surface 682 that originates adjacent first edge 684 and extends downwardly therefrom.

A portion of cable 58*b* may be fitted within groove 683 so that a first end 59*b* of cable 58*b* extends past front surface 675 of main body 678 and a second end 61*b* of cable 58*b* extends past bottom surface 679 of main body 678 and along service-line-engaging surface 682 of stop tab 680 as shown best in FIG. 17. When cable 58*b* is installed in retainer 674 and retainer 674 is installed in service-line-receiving space 698 of housing 601, cable 58*b* is retained in service-line-receiving space 698 and retainer 674 resists movement of cable 58*b* away from service-line-receiving space 698. A portion of cable 58*b* extending past bottom surface 679 is sandwiched between stop surface 646 of housing 601 and service-line-engaging surface 682 and back surface 676 of retainer 674 is generally coplanar with back surface 604 of housing 601.

Figure 14:
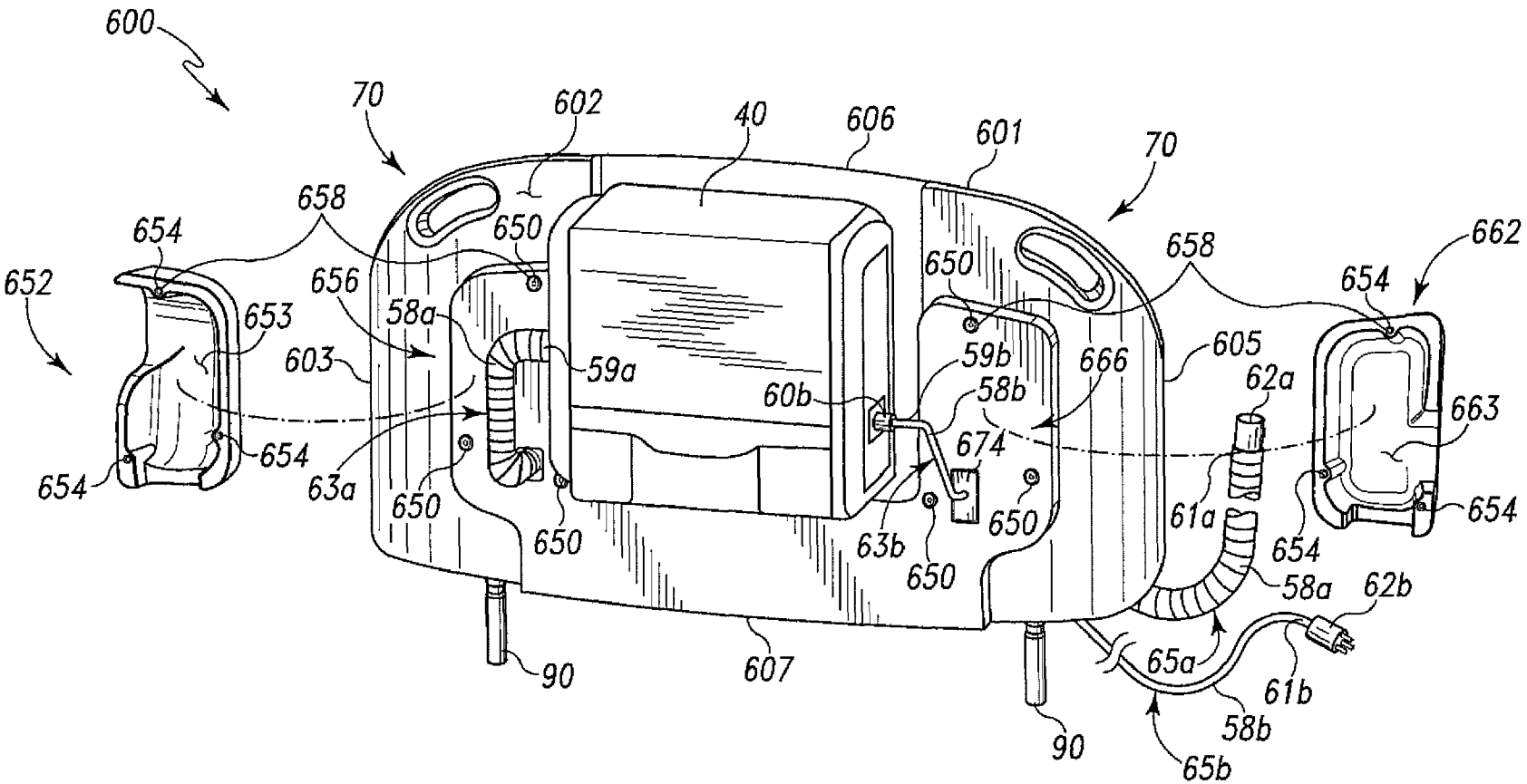
FIG. 14 is an exploded perspective view of the front of the endboard of FIG. 13 supporting the service supply and showing service lines associated therewith.

Further, cable 58*b* is provided with a first connector 60*b* operably coupled to first end 59*b* of cable 58*b* and a second connector 62*b* operably coupled to second end 61*b* of cable 58*b* so that first connector 60*b* is in electrical communication with second connector 62*b*. When cable 58*b* is installed in retainer 674 and retainer 674 is installed in service-line-receiving space 698 of housing 601, a portion 63*b* of cable 58*b* including first end 59*b* of cable 58*b* extends through second channel 624 and past channel opening 628 so that first connector 60*b* extends past front surface 602 of housing 601 and is accessible to caregivers in front of endboard 600, for example, for use with service supply 40 as shown in FIGS. 14, 16, and 17. Likewise, a portion 65*b* of cable 58*b* including second end 61*b* of cable 58*b* extends through slot 648 so that second connector 62*b* is accessible from the rear of endboard 600, for example, to be operably coupled to a power supply socket (not shown), thereby providing an electrical power signal from the power supply socket, through endboard 600, to service supply 40.

At least a portion of hose 58*a* is received by the interior region of housing 601 of endboard 600 when hose 58*a* is installed in endboard 600 as shown best in FIG. 16. A portion 63*a* of hose 58*a* including first end 59*a* of hose 58*a* extends from within first service-line-receiving space 608 past first channel opening 614 so that connector 60*a* of hose 58*a* extends past front surface 602 of housing 601 and is accessible to caregivers in front of endboard 600 for use with service supply 40 as shown in FIGS. 14 and 16. A portion 65*a* of hose 58*a* including second end 61*a* of hose 58*a* extends from within first service-line-receiving space 608 past second channel opening 618 so that connector 62*a* of hose 58*a* extends past back surface 604 of housing 601 and is accessible for use with care equipment (not shown).

A plate or channel cover 670 is removably secured to back surface 604 of endboard 600 using fasteners 658 as shown best in FIG. 16. Fasteners 658 include snap posts 654 coupled to plate 670 that cooperate with corresponding snap sockets 650 coupled to back surface 604 of housing 601. Snap sockets are available from Scovill Fasteners, Inc., part number 93-xx-10224 and snap posts are also available from Scovill Fasteners, Inc., part number 93-x8-10314-2A. While fasteners 658 include snap posts 654 fixed to plate 670 and snap sockets 650 fixed to back surface 604, these may be reversed with snap posts 654 fixed to back surface 604 and snap sockets 650 fixed to plate 670. Additionally, while fasteners 658 include snap posts 654 and snap sockets 650, any suitable fastener for coupling plate 670 to back surface 604, including hook and loop fasteners, threaded fasteners, nuts, adhesives, hinges, snap fit assemblies integrally molded into plate 670 or integrally molded into back surface 604, and the like, may be employed to couple plate 670 to back surface 604.

Figure 15:
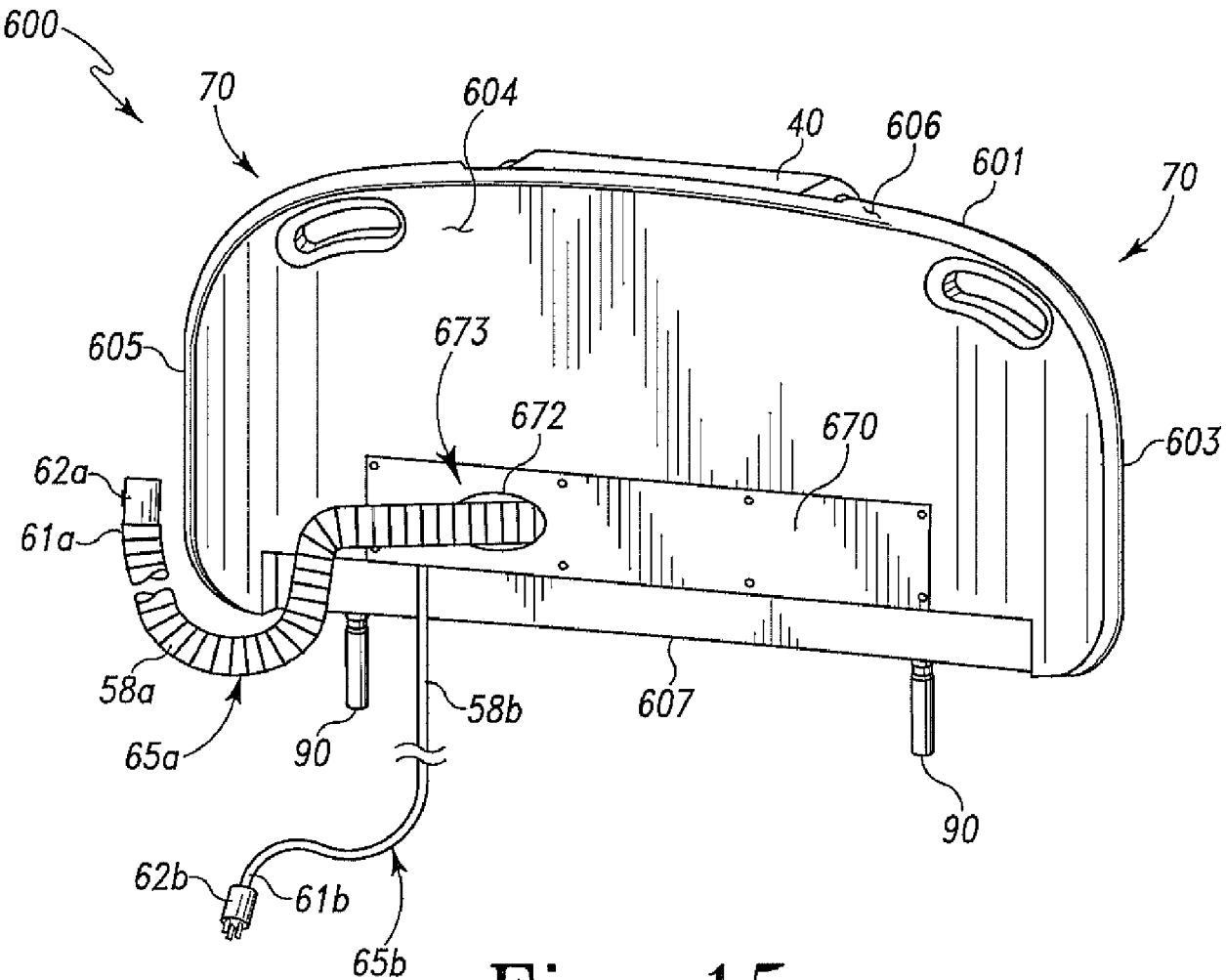
FIG. 15 is perspective view of the back surface of the endboard of FIG. 14 showing a hose and an electrical power cable extending from an interior region of the endboard.

Plate 670 conceals fourth channel opening 632 and a portion of second channel openings 618 as shown best in FIG. 15. Plate 670 is formed to include an edge 672 defining a channel cover aperture 673 extending through plate 670. Channel cover aperture 673 is adjacent second channel opening 618, first service-line-receiving space 608, and first channel opening 614 when plate 670 is installed on back surface 604. When a portion of hose 58*a* is installed in the interior region of housing 601 and plate 670 is installed on back surface 604, second end 61*a* of hose 58*a* extends from within first service-line-receiving space 608, past second channel opening 618 of back surface 604, through channel cover aperture 673, to extend past back surface 604 of housing 601 and past plate 670, as shown in FIG. 15, so that it is accessible for use with care equipment (not shown).

Plate 670 retains at least a portion of hose 58*a* within the interior region of housing 601 and within service-line-receiving space 608 and resists movement of at least a portion of hose 58*a* away from the interior region of housing 601 and away from service-line-receiving space 608. In addition, when retainer 674 is installed in service-line-receiving space 698 of housing 601 as shown in FIGS. 16 and 17, and plate 670 is installed on back surface 604, plate 670 covers channel opening 632 and retainer 674, cable 58*b* is retained in service-line-receiving space 698 and plate 670 resists movement of retainer 674 and cable 58*b* away from service-line-receiving space 698.

When hose 58*a*, cable 58*b*, retainer 674, and plate 670 are installed on housing 601, as shown best in FIGS. 14 and 15, portion 63*a* of hose 58*a* including first end 59*a* and hose connector 60*a* extends past first channel opening 614 of front surface 602 of housing 601, as shown in FIGS. 14 and 16, so that hose connector 60*a* is accessible to a caregiver in front of endboard 600 and is available to be operably coupled to service supply 40. Furthermore, portion 65*a* of hose 58*a* including second end 61*a* of hose 58*a* and connector 62*a* extends from within first service-line-receiving space 608, past second channel opening 618 of back surface 604, through channel cover aperture 673, to extend past back surface 604 of housing 601 and past plate 670, as shown in FIG. 15, so that it is accessible for use with care equipment (not shown). Likewise, portion 63*b* of cable 58*b* including first end 59*b* and connector 60*b* extends past third channel opening 628 of front surface 602 so that connector 60*b* is available to be operably coupled to service supply 40. Portion 65*b* of cable 58*b* including second end 61*b* and connector 62*b* is available to be operably coupled to either a power source such as a power source in a room or power connector 37 illustratively located on base 16 of patient support 20 as shown in FIG. 1, or to care equipment, as appropriate.

While illustrative cable 58*b* is a power cable providing electrical power from a power source to service supply 40, cable 58*b* may also be a power cable providing electrical power from service supply 40 to care equipment or from another source of electrical power to care equipment. Cable 58*b* may also communicate an electrical data signal or other electrical signal between service supply 40 and care equipment, between service supply 40 and equipment other than care equipment, or between care equipment and equipment other than service supply 40.

It can be seen that a portion of service lines 58 including a portion of hose 58*a* and a portion of cable 58*b* are received in the interior region of housing 601, that at least a portion of hose 58*a* is received in the interior region of housing 601 when first end 59*a* of hose 58*a* is operably coupled to service supply 40 and second end 61*a* of hose 58*a* is operably coupled to care equipment. In addition, at least a portion of cable 58*b* is received in the interior region of housing 601 when connector 60*b* is operably coupled to service supply 40 and second connector 62*b* is operably coupled to the power connector of the frame (not shown) or to care equipment, as appropriate.

When hose connector 60*a* of hose 58*a* is operably coupled to service supply 40, portion 63*a* of hose 58*a* is exposed adjacent front surface 602 as shown in FIG. 14. Likewise, when connector 60*b* of cable 58*b* is operably coupled to service supply 40, portion 63*b* of cable 58*b* is exposed adjacent front surface 602.

First channel cover 652 and second channel cover 662 may be provided as shown in FIGS. 14 and 16 to cover exposed portions 63*a* and 63*b* of hose 58*a* and cable 58*b*, respectively. Channel covers 652, 662 are provided with fasteners 658, shown best in FIG. 14, to removably coupled channel covers 652, 662 to front surface 602 of housing 601. Fasteners 658 include snap posts 654 fixed to channel covers 652, 662, and snap sockets 650 fixed to front surface 602. As described above in connection with plate 670, while fasteners 658 include snap posts 654 fixed to channel covers 652, 662 and snap sockets 650 fixed to front surface 602, these may be reversed with snap posts 654 fixed to front surface 602 and snap sockets 650 fixed to channel covers 652, 662. Additionally, while fasteners 658 include snap posts 654 and snap sockets 650, any suitable fastener for coupling channel covers 652, 662 to front surface 602, including hook and loop fasteners, threaded fasteners, nuts, adhesives, hinges, snap fit assemblies integrally molded into channel covers 652, 662 or integrally molded into front surface 602, and the like, may be employed to couple channel covers 652, 662 to front surface 602.

Figure 13:
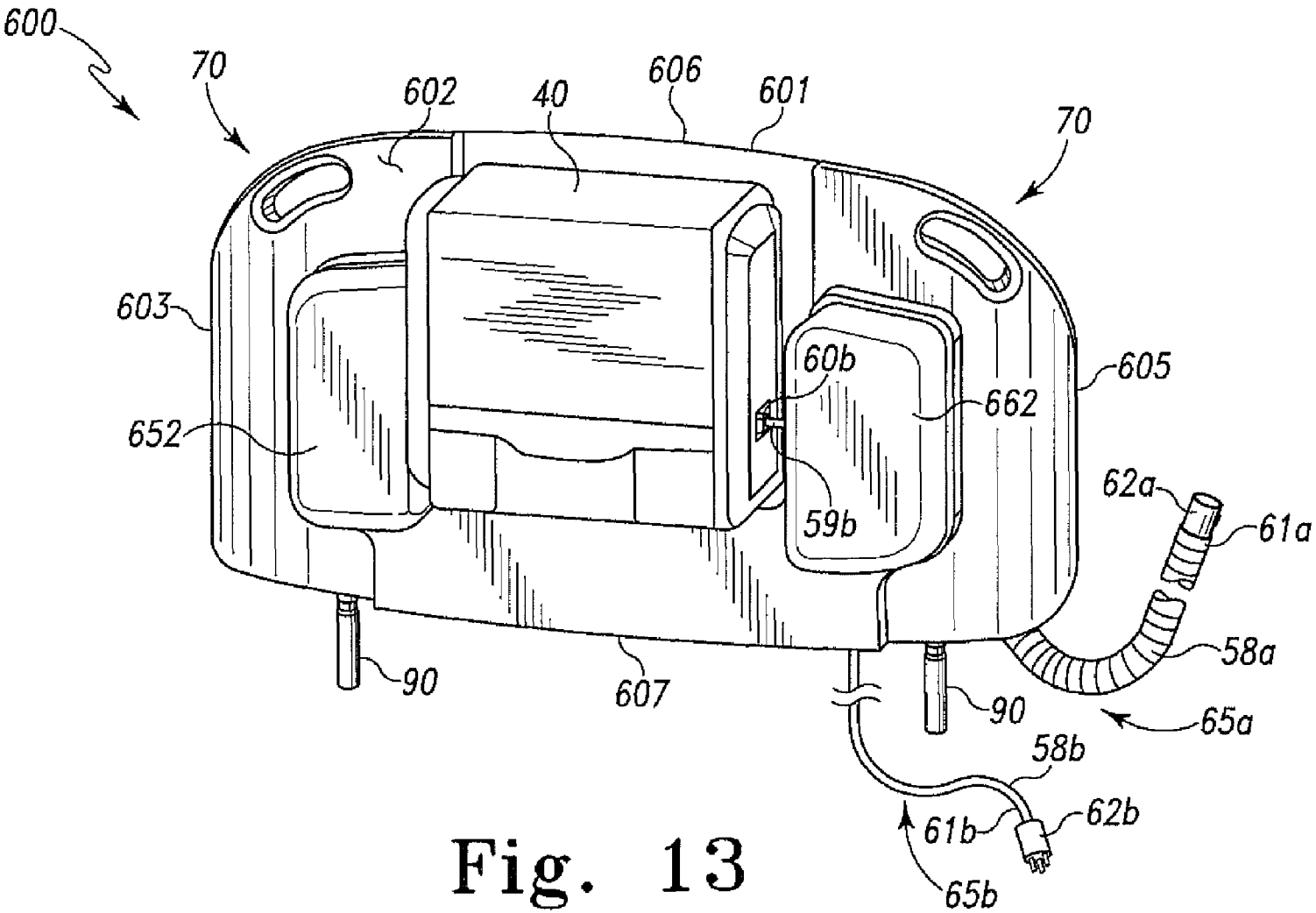
FIG. 13 is a perspective view of the endboard of FIG. 12 supporting a service supply and including covers in a closed position coupled to the front surface.

First channel cover 652 has a first cover surface 653 and second channel cover 662 has a second cover surface 663, as shown in FIG. 14. First and second cover surfaces 653, 663 conceal exposed portions 63*a* and 63*b* of hose 58*a* and cable 58*b*, as shown in FIGS. 13 and 14, when channel covers 652, 662 are installed on front surface 602. In addition, first and second cover surfaces 653, 663 conceal at least a portion of first and third channel openings 614, 628, respectively, when channel covers 652, 662 are installed on front surface 602.

Channel covers 652, 662 wholly obstruct channel openings 614 and 628, respectively, as shown best in FIG. 13. It should be noted that plate 670 partially obstructs channel opening 618, as shown in FIG. 15, in which channel cover aperture 673 exposes a portion of channel opening 618. Channel openings may be covered by channel covers or plates that partially obstruct or wholly obstruct their associated channel openings. Likewise, channel covers or plates may be configured to sealingly engage the front surface or back surface of the housing adjacent the channel opening to inhibit or block the passage of solid, liquid, or gaseous material.

Thus, channel covers or plates may be configured to block or inhibit the escape of a service supplied by a service supply from a channel or channel covers or plates may be configured to block or inhibit the ingress of contaminants into a channel. For example, a channel cover may cover a channel supplied with pressurized air from an air source and may be configured to block or inhibit the escape of pressurized air from the channel. Additionally, channel covers may improve the cleanability of an endboard by covering portions of service lines or covering openings thus preventing the ingress of contaminants thereto. Finally, covers may provide aesthetic benefits to an endboard by concealing service lines.

First cover surface 653 of first channel cover 652 cooperates with front surface 602 of endboard 600 to define a service-line-receiving space 656. First cover surface 653 retains at least a portion of hose 58*a* within service-line-receiving space 656 and resists movement of at least a portion of hose 58*a* away from front surface 602 of housing 601 and away from service-line-receiving space 656 so that first channel cover 652 operates as a line support or retainer. Likewise, second cover surface 663 of second channel cover 662 cooperates with front surface 602 of endboard 600 to define a service-line-receiving space 666. Second cover surface 663 retains at least a portion of hose 58*a* within service-line-receiving space 666 and resists movement of at least a portion of cable 58*b* away from front surface 602 of housing 601 and away from service-line-receiving space 666 so that second channel cover 662 operates as a line support or retainer.

A caregiver wishing to supply pressurized air to mattress 28 may install hose 58*a* and cable 58*b* into housing 601 as described above in connection with FIGS. 14-17 or the caregiver may be provided with endboard 600 having hose 58*a* and cable 58*b* preinstalled as shown best in FIGS. 14 and 15. The caregiver may mount service supply 40 to endboard 600 as shown in FIGS. 13 and 14 using optional service-supply coupler 52 or other methods as previously described. The caregiver may couple one end of hose 58*a* to service supply 40 and the other end of hose 58*a* to mattress 28. The caregiver may then couple one end of cable 58*b* to service supply 40 and the other end of cable 58*b* to a power source such as a power source in a room or power connector 37 illustratively located on base 16 of patient support 20 as shown in FIG. 1, or to care equipment, as appropriate. If desired, the caregiver may then couple first and second channel covers 653, 663 to front surface 602 of housing 601, as shown best in FIG. 13.

Another embodiment of an endboard 700 is shown in FIG. 18. Endboard 700 shares many common features with endboard 600. Endboard 700 differs from endboard 600 as described below.

Endboard 700 includes a second connector 762 mounted to a second end (not shown) of cable 58*b* as shown in FIG. 18. Second connector 762 is coupled to housing 601 adjacent to bottom 607 of endboard 700 and is in communication with first connector 60*b*. Endboard 700 also includes an electrical data cable (not shown) received within the interior region of housing 601. The electrical data cable has a first end (not shown) terminating in a first data connector 784 and a second end (not shown) terminating in a second data connector 753. First data connector 784 is coupled to front surface 602 of housing 601 and is in electrical communication with second data connector 753. Second data connector 753 is coupled to housing 601 adjacent to bottom 607 of endboard.

Frame 786 is provided with a connector 768 mounted to frame 786 as shown in FIG. 18. Connector 768 is configured to be operably coupled to second connector 762 of endboard 700. Additionally, frame 786 is provided with a connector 763 mounted to frame 786. Connector 763 is configured to be operably coupled to second data connector 753 of endboard 700.

Endboard 700 includes a first connector-alignment apparatus 750 coupled to endboard 700 as shown in FIG. 18. A second connector-alignment apparatus 760 is coupled to frame 786. Frame 786 and endboard 700 are provided with coupler 50 configured to couple housing 601 to Frame 786. Frame 786 is formed to include apertures 92 that receive posts 90 of endboard 700 during installation of endboard 700 onto frame 786. Posts 90 and apertures 92 therefore provide initial alignment between endboard 700 and frame 786. First and second connector-alignment apparatuses 750 and 760 provide further alignment for male and female electrical connectors 762, 753 and 768, 763.

First connector-alignment apparatus 750 is configured to receive a first pair of electrical connectors 762, 753 shown in FIG. 18. First connector-alignment apparatus 750 includes a housing 756 and a base plate (not shown) having outwardly extending alignment posts 754 located at opposite ends. Posts 754 each include tapered head portions. Second connector-alignment apparatus 760 includes a housing 767 and a base plate (not shown) having apertures 765 (shown in phantom). Apertures 765 are formed to receive alignment posts 754 when housing 756 of first connector-alignment apparatus 750 is engaged with housing 767 of second connector-alignment apparatus 760.

First connector-alignment apparatus 750 is rigidly coupled within a recessed portion 780 formed in endboard 700 as shown in FIG. 18. Second connector-alignment apparatus 760 is loosely connected to frame 786. During installation of endboard 700 on to the frame 786, initial alignment is provided by posts 90 on endboard 700 extending into apertures 92 formed in frame 786. As posts 90 of endboard 700 moves downwardly into apertures 92, posts 754 on first connector-alignment apparatus 750 enter apertures 765 in second connector-alignment apparatus 760. Tapered surfaces on posts 754 and tapered surfaces of apertures 765 facilitate insertion of posts 754 into apertures 765. Since housing 767 of second connector-alignment apparatus 760 can float on the frame 786, housing 767 moves into proper alignment with the first connector-alignment apparatus 750 as endboard 700 is installed. This ensures proper alignment between connectors 762, 753 and 768, 763. Thus, first and second alignment apparatuses 750, 760 cause first connector 60*b* to be operably coupled to connector 768 and first data connector 784 to be operably coupled to connector 763 automatically when endboard 700 is installed on frame 786.

Typically, connector 768 of frame 786 is operably coupled to an electrical power source (not shown) and connector 763 of frame 786 is operably coupled to an electrical data source (not shown). Thus, first and second alignment apparatuses 750, 760 cause first connector 60*b* to be operably coupled to the electrical power source and first data connector 784 to be operably coupled to the electrical data source automatically when endboard 700 is installed on frame 786.

A caregiver wishing to supply pressurized air to mattress 28 and to establish electrical data communication and transmit electrical power between service supply 40 and patient support 20 may do so using endboard 700 as shown in FIG. 18. The caregiver may couple endboard 700 to patient support 20 by grasping handles 70 of endboard 700 then lowering endboard 700 so that mounting posts 90 of endboard 700 are received by openings 92 of frame 786. The caregiver may then mount service supply 40 to endboard 700 using optional service-supply coupler 52 or other methods as previously described.

The caregiver may couple one end of hose 58*a* to service supply 40 and the other end of hose 58*a* to mattress 28. The caregiver may then couple connector 60*b* of cable 58*b* to service supply 40 to operably couple service supply 40 to the electrical power source. The caregiver may likewise couple a first connector (not shown) of a service-supply data cable (not shown) to first data connector 784 of endboard 700 and a second end (not shown) of the service-supply data cable to service supply 40 to operably couple service supply 40 to the electrical data source.

While endboard 700 includes second electrical-power connector 762 and second electrical-data connector 753 adjacent bottom 607 of endboard 700 to allow coupling with the service supplies located on patient-support frame 786, hose couplers of types providing services such as pressurized air and fluids may be used for coupling with compatible hose couplers fixed to patient-support frame 786. For example, Colder Products Company connectors PLM-220-06 and PLC 160-06 may be used for coupling pressurized air between the patient-support frame 786 and endboard 700. Additionally, service lines may be coupled to service supplies mounted in patient-support frame 786 and having at least a portion of the service line routed through the housing 701 of endboard 700 to terminate with a connector coupleable to care equipment.

The foregoing description of the present invention is not intended to limit the scope of the present invention to the precise terms set forth. Although the present invention has been described in detail with reference to illustrative embodiments, variations and modifications exist within the scope and spirit of the present invention in accordance with the following claims.

The invention claimed is:

1. An endboard for a patient support including a frame having a head end and a foot end, care equipment adjacent the frame, a service supply, and a service line operably coupling the service supply to the care equipment, the endboard comprising:

a housing including a front surface, a back surface spaced apart from the front surface by a depth of the housing, a top, a bottom spaced apart from the top by a height of the housing, a first end and a second end spaced apart from the first end by a width of the housing, the front surface facing outwardly away from the patient support when the endboard is installed on the patient support, the top extending upwardly from the patient support when the endboard is installed on the patient support, at least a portion of the front surface cooperating with at least a portion of the back surface to define an interior region, and at least one of the front surface and the back surface define a service supply mounting region having a perimeter generally corresponding to a perimeter of the service supply when the service supply is mounted to the housing, and a line support located proximate to the service supply mounting region and configured to support at least a portion of the service line, the line support defined by a first channel having a first opening formed in the front surface of the housing and second opening formed in the back surface of the housing, a second channel having a first opening formed in the front surface of the housing and second opening formed in the back surface of the housing, and a third channel formed in the interior space connecting the first and second channels.

2. The endboard of claim 1, further comprising a second line support located proximate to the service supply mounting region and spaced apart from the first line support, the second line support configured to support a second portion of the service line.

3. The endboard of claim 1, wherein the line support includes a first leg, a second leg spaced apart from the first leg, the first leg cooperating with the second leg to define a space therebetween that is configured to receive the service line.

4. The endboard of claim 1, further comprising an edge defining an aperture extending through one of the front surface, the back surface, the top, the bottom, the first end, and the second end of the housing so that the aperture is in communication with the interior region of the housing and at least a portion of the edge defines the line support.

5. The endboard of claim 1, further comprising a first edge defining a first aperture extending through one of the front surface, the back surface, the top, the bottom, the first end, and the second end of the housing, a second edge defining a second aperture extending through one of the front surface, the back surface, the top, the bottom, the first end, and the second end of the housing, and a surface extending between the first edge and the second edge and defining a channel therebetween, at least a portion of the surface defining the line support.

6. The endboard of claim 1, further comprising a first edge defining the first aperture extending through one of the front surface, the back surface, the top, the bottom, the first end, and the second end of the housing, a second edge defining the second aperture extending through one of the front surface, the back surface, the top, the bottom, the first end, and the second end of the housing, the second aperture in fluid communication with the first aperture, wherein the service line is a hose and the line support is a hose coupler coupled to the housing adjacent the first aperture and configured to support the hose proximate to the housing, and further comprising a second hose and a second line support, the second line support being a second hose coupler coupled to the housing adjacent the second aperture and configured to support the hose proximate to the housing so that the second hose is in fluid communication with the first hose through the second aperture and the first aperture.

7. The endboard of claim 1, wherein the service line is an electrical cable including a first end, a second end, and a connector appended to one of the first and second ends of the electrical cable, and further comprising a first edge defining a first aperture extending through the front surface of the housing, the line support being a first electrical connector fixed to the housing adjacent the first aperture, the first electrical connector configured to mate with the connector of the electrical cable so that the electrical cable is in electrical communication with the first electrical connector.

8. The endboard of claim 1, wherein the line support includes a cover having a cover surface configured to support at least a portion of the service line.

9. An endboard for a patient support including a frame having a head end and a foot end, care equipment adjacent the frame, a service supply, and a service line operably coupling the service supply to the care equipment, the endboard comprising:

a housing including a front surface, a back surface spaced apart from the front surface by a depth of the housing, a top, a bottom spaced apart from the top by a height of the housing, a first end and a second end spaced apart from the first end by a width of the housing, the front surface facing outwardly away from the patient support when the endboard is installed on the patient support, the top extending upwardly from the patient support when the endboard is installed on the patient support, at least a portion of the front surface cooperating with at least a portion of the back surface to define an interior region, and at least one of the front surface and the back surface define a service supply mounting region having a perimeter generally corresponding to a perimeter of the service supply when the service supply is mounted to the housing, and a line support located proximate to the service supply mounting region and configured to support at least a portion of the service line, a first edge defining a first aperture extending through the front surface, a second edge defining a second aperture extending through the back surface, a first channel surface extending between the first edge and the second edge and defining a first channel therebetween, a third edge defining a third aperture extending through the front surface, a fourth edge defining a fourth aperture extending through the back surface, a second channel surface extending between the third edge and the fourth edge and defining a second channel therebetween, a fifth edge defining a fifth aperture extending through the first channel surface, a sixth edge defining a sixth aperture extending through the second channel surface, a third channel surface extending between the fifth edge and the sixth edge and defining a third channel therebetween, at least a portion of at least one of the first, second, and third channel surfaces defining the line support.

10. An endboard for a patient support including a frame having a head end and a foot end, care equipment adjacent the frame, a service supply, and a service line operably coupling the service supply to the care equipment, the endboard comprising:

a housing including a front surface, a back surface spaced apart from the front surface by a depth of the housing, a top, a bottom spaced apart from the top by a height of the housing, a first end and a second end spaced apart from the first end by a width of the housing, the front surface facing outwardly away from the patient support when the endboard is installed on the patient support, the top extending upwardly from the patient support when the endboard is installed on the patient support, at least a portion of the front surface cooperating with at least a portion of the back surface to define an interior region, and at least one of the front surface and the back surface define a service supply mounting region having a perimeter generally corresponding to a perimeter of the service supply when the service supply is mounted to the housing, and a line support located proximate to the service supply mounting region and configured to support at least a portion of the service line, a first edge defining a first aperture extending through the front surface, a second edge defining a second aperture extending through the back surface, a channel surface extending between the first edge and the second edge and defining a first channel therebetween, and a third edge defining a third aperture extending through the first channel surface, at least a portion of the third edge defining the line support.

11. An endboard for a patient support including a frame having a head end and a foot end, care equipment adjacent the frame, a service supply, and a service line configured to operably couple the service supply to the care equipment, the endboard comprising a panel including a top edge extending upwardly above the frame, and a coupler configured to secure the panel adjacent at least one of the head end and the foot end of the frame, the panel further including first and second handles, a front surface facing outwardly away from the frame and a back surface spaced apart therefrom, the front surface of the panel including a first edge defining a first channel opening, the back surface of the panel including a second edge defining a second channel opening, and a channel surface connecting the first edge and the second edge thereby defining a channel extending from the front surface through the panel and to the back surface, wherein the channel is a first channel, the channel surface is the first channel surface, and the front surface of the panel includes a third edge defining a third channel opening, the back surface of the panel including a fourth edge defining a fourth channel opening, and a second channel surface connects the third edge and the fourth edge thereby defining a second channel extending between the front surface and the back surface and configured to carry the service line, wherein the first channel surface includes a fifth edge defining a fifth channel opening, the second channel surface includes a sixth edge defining a sixth channel opening, and a third channel surface connects the fifth edge and the sixth edge thereby defining a third channel extending between the first channel and the second channel and configured to carry the service line.

12. The endboard of claim 11, wherein the service line is a hose, the channel is configured to conduct air therethrough, and further comprising a retainer mounted adjacent one of the first and second apertures and configured to couple the hose to the endboard so that the hose is in fluid communication with the channel.

13. The endboard of claim 12, further comprising a second retainer mounted adjacent the other of the first and second apertures and configured to couple the hose to the endboard so that the hose is in fluid communication with the channel.

14. The endboard of claim 11, wherein the channel defines an axis extending generally normal to the front surface.

15. The endboard of claim 11, wherein the channel defines an axis extending generally parallel to the front surface.

16. The endboard of claim 11, further comprising a retainer mounted to the front surface of the panel adjacent the first channel opening and configured to couple the service line to the panel and to operably couple the service line to the first channel opening, the channel, and the second channel opening.

17. The endboard of claim 16, wherein the service line is a first service line, the retainer is a first retainer, and a second service line is configured to operably couple the service supply to the care equipment, the endboard further comprising a second retainer mounted to the back surface of the panel adjacent the second channel opening and configured to couple the second service line to the panel and to operably couple the second service line to the second channel opening, the channel, the first channel opening, and the first service line.

18. The endboard of claim 17, wherein the care equipment is a mattress defining an interior region including a bladder, the service supply includes an air supply, the first service line is a first hose, the second service line is a second hose, and the channel is configured so that the air supply is in fluid communication with the bladder through the first hose, through the channel, and through the second hose when the mattress is operably coupled to the air supply.

19. The endboard of claim 11, wherein the third channel defines an axis extending generally parallel to the front surface of the panel.

20. The endboard of claim 11 further comprising a cover plate configured to be coupled to the panel and to cover at least a portion of one of the first channel opening and the second channel opening when the cover plate is coupled to the panel.

21. The endboard of claim 20, wherein the cover plate includes an edge defining an aperture sized to allow the service line to extend therethrough.

22. The endboard of claim 20, wherein the cover plate is configured to be removably coupled to the panel.

23. The endboard of claim 20, wherein the cover plate is configured to be pivotably coupled to the panel.

* * * * *